US010488792B2

(12) United States Patent
Sako et al.

(10) Patent No.: US 10,488,792 B2
(45) Date of Patent: Nov. 26, 2019

(54) IMAGE HEATING APPARATUS AND IMAGE FORMING APPARATUS THAT CONTROL ELECTRICAL POWER SUPPLIED TO FIRST AND SECOND HEAT GENERATING BLOCKS

(71) Applicant: CANON KABUSHIKI KAISHA, Tokyo (JP)

(72) Inventors: Masato Sako, Susono (JP); Atsushi Iwasaki, Susono (JP); Keisuke Mochizuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/157,563

(22) Filed: Oct. 11, 2018

(65) Prior Publication Data

US 2019/0049881 A1 Feb. 14, 2019

Related U.S. Application Data

(63) Continuation of application No. 15/657,489, filed on Jul. 24, 2017, now Pat. No. 10,114,318.

(30) Foreign Application Priority Data

Jul. 28, 2016 (JP) ..... 2016-148476

(51) Int. Cl.
*G03G 15/20* (2006.01)
*G03G 15/00* (2006.01)

(52) U.S. Cl.
CPC ..... *G03G 15/2039* (2013.01); *G03G 15/2042* (2013.01); *G03G 15/80* (2013.01)

(58) Field of Classification Search
CPC ..... G03G 15/2042
See application file for complete search history.

(56) References Cited

U.S. PATENT DOCUMENTS 8,494,383 B2 7/2013 Shimura et al.
8,698,046 B2 4/2014 Shimura et al.
(Continued)

FOREIGN PATENT DOCUMENTS

JP H07-20673 A 1/1995
JP 2011-018027 A 1/2011
(Continued)

OTHER PUBLICATIONS

Extended European Search Report dated Dec. 5, 2017, issued in counterpart European Patent Application No. 17183463.3.

*Primary Examiner* — Clayton E. LaBalle
*Assistant Examiner* — Jas A Sanghera
(74) *Attorney, Agent, or Firm* — Venable LLP

(57) ABSTRACT

An image heating apparatus includes a heater including a first heat generating block and a second heat generating block, and a power control portion that controls electrical power to be supplied to the respective heat generating blocks. When a recording material passes the position of the heater, and, in a longitudinal direction of the heater, when an entire range in which the second heat generating block is provided is a range in which the recording material passes and only a portion of a range in which the first heat generating block is provided is a range in which the recording material passes, the power control portion controls the electrical power to be supplied to the respective heat generating blocks so that electrical power Wd supplied to the first heat generating block is less than electrical power Wc supplied to the second heat generating block.

10 Claims, 23 Drawing Sheets

(56) References Cited

U.S. PATENT DOCUMENTS

| | | | | |
|---|---|---|---|---|
| 9,170,550 | B2 | 10/2015 | Shimura et al. | |
| 9,235,166 | B2 | 1/2016 | Shimura | |
| 9,335,709 | B2 | 5/2016 | Iwasaki et al. | |
| 9,665,048 | B2 | 5/2017 | Iwasaki et al. | |
| 10,054,882 | B2 | 8/2018 | Nomura et al. | |
| 10,114,318 | B2 * | 10/2018 | Sako | G03G 15/2039 |
| 2007/0217804 | A1 | 9/2007 | Mikita et al. | |
| 2013/0195494 | A1 | 8/2013 | Asami et al. | |
| 2013/0299480 | A1 * | 11/2013 | Kakubari | G03G 15/2053 219/216 |
| 2015/0037052 | A1 | 2/2015 | Muramatsu et al. | |
| 2016/0085187 | A1 | 3/2016 | Takagi | |
| 2018/0004135 | A1 | 1/2018 | Sako et al. | |
| 2018/0004136 | A1 | 1/2018 | Iwasaki | |
| 2018/0032008 | A1 | 2/2018 | Sako et al. | |

FOREIGN PATENT DOCUMENTS

| | | | |
|---|---|---|---|
| JP | 2011-151003 | A | 8/2011 |
| JP | 2014-059508 | A | 4/2014 |
| JP | 2016-065915 | A | 4/2016 |
| JP | 2016-114914 | A | 6/2016 |

* cited by examiner

THERMISTOR TH2 TEMPERATURE
CASE WHERE PRESENT EMBODIMENT IS NOT USED
CASE WHERE PRESENT EMBODIMENT IS USED
THMax
NUMBER OF PASSING SHEETS

THROUGHPUT
CASE WHERE PRESENT EMBODIMENT IS NOT USED
64.3ppm
49ppm
NUMBER OF PASSING SHEETS THROUGHPUT
64.3ppm
CASE WHERE PRESENT EMBODIMENT IS USED
30 PAGES
100 PAGES
NUMBER OF PASSING SHEETS

IMAGE HEATING APPARATUS AND IMAGE FORMING APPARATUS THAT CONTROL ELECTRICAL POWER SUPPLIED TO FIRST AND SECOND HEAT GENERATING BLOCKS

This application is a continuation application of U.S. patent application Ser. No. 15/657,489, filed Jul. 24, 2017, which claims the benefit of Japanese Patent Application No. 2016-148476, filed Jul. 28, 2016, which are hereby incorporated by reference herein in their entireties.

BACKGROUND OF THE INVENTION

Field of the Invention

The present invention relates to an image forming apparatus, such as a copying machine or a printer, that uses an electrophotographic system or an electrostatic recording system. The present invention also relates to an image heating apparatus, such as a fixing unit, mounted on an image forming apparatus, and a gloss applying apparatus that heats the toner image fixed on a recording material again (i.e., a second time) in order to improve the gloss level of the toner image.

Description of the Related Art

An example of an image heating apparatus provided in an image forming apparatus that uses an electrophotographic system, an electrostatic recording system, or the like, includes a fixing film, a heater that makes contact with an inner surface of the fixing film, and a roller that forms a nip portion together with the heater with the fixing film interposed therebetween. In an image forming apparatus mounted with such an image heating apparatus, when an image is continuously formed (referred to as continuous printing) on a recording material having a size less than a maximum sheet-passing width in a direction orthogonal to a conveying direction of the recording material (referred to as a longitudinal direction), a so-called temperature rise in a non-sheet-passing portion occurs. That is, a phenomenon occurs in which the temperature of respective parts in a region, in which a recording material does not pass (referred to as a non-sheet-passing portion) in the longitudinal direction of the nip portion, increases gradually. As for an image heating apparatus, it is necessary to suppress the temperature of the non-sheet-passing portion from exceeding a heat-resistant temperature of each member in the apparatus. Therefore, a method of suppressing the temperature rise in the non-sheet-passing portion by decreasing the throughput of continuous printing (the number of sheets printable per minute) (referred to as throughput down) may be used.

In contrast, a method proposed in Japanese Patent Application Publication No. 2011-151003 is an example of a method for suppressing the temperature rise in the non-sheet-passing portion without decreasing the throughput as much as possible. The method of Japanese Patent Application Publication No. 2011-151003 is a method in which a heat generating resistor (referred to as a heat generating element) on a substrate of a heater is formed of a material having positive resistance-temperature characteristics, and a current flows in a conveying direction (referred to as a transverse direction) of the recording material in relation to the heat generating element (referred to as conveying direction energization). Positive resistance-temperature characteristics are such characteristics that a resistance increases as the temperature increases. In this method, when the temperature of a non-sheet-passing portion increases, the resistance of the heat generating element of the non-sheet-passing portion increases and the current flowing into the heat generating element of the non-sheet-passing portion is suppressed whereby the temperature rise in the non-sheet-passing portion is suppressed.

Moreover, a method in which a heater is divided into a plurality of heat generating blocks at positions corresponding to the size of a recording material in a longitudinal direction of the heater and electrical power to be supplied to respective divided heat generating blocks is controlled independently is also known (Japanese Patent Application Publication No. 2014-59508). In this method, electrical power is not supplied to a heat generating block corresponding to a region through which a recording material does not pass in cases other than necessary. Therefore, it is possible to suppress the temperature rise in the non-sheet-passing portion more effectively than the method of Japanese Patent Application Publication No. 2011-151003.

It is difficult, however, to completely prevent the temperature rise in the non-sheet-passing portion. When the temperature rise in the non-sheet-passing portion reaches a predetermined level, it is necessary to execute countermeasures, such as decreasing the throughput or suspending the printing, to wait until the temperature of the heater is equalized.

SUMMARY OF THE INVENTION

An object of the present invention is to provide a technique for minimizing the throughput down for recording materials having various sheet widths and suppressing an increase in a standby period.

According to one aspect, the present invention provides an image heating apparatus that heats an image formed on a recording material, the image heating apparatus including a heater including a first heat generating block, and a second heat generating block disposed adjacent to the first heat generating block in a longitudinal direction of the heater, the longitudinal direction being orthogonal to a conveying direction of the recording material. The image heating apparatus also includes a power control portion that controls electrical power to be supplied to the first and second heat generating blocks, the power control portion being capable of controlling the electrical power to be supplied to the first and second heat generating blocks independently, wherein, when the recording material passes the position of the heater, and in the longitudinal direction, when an entire range in which the second heat generating block is provided is a range in which the recording material passes and only a portion of a range in which the first heat generating block is provided is a range in which the recording material passes, the power control portion controls the electrical power to be supplied to the first and second heat generating blocks so that an electrical power Wd supplied to the first heat generating block is less than an electrical power We supplied to the second heat generating block.

According to another aspect, the present invention provides an image forming apparatus including an image forming portion that forms an image on a recording material, and a fixing portion that fixes the image formed on the recording material to the recording material, wherein the fixing portion is the image heating apparatus.

Further features of the present invention will become apparent from the following description of exemplary embodiments with reference to the attached drawings.

DESCRIPTION OF THE EMBODIMENTS

A description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Embodiment 1

(Entire Configuration of Fixing Apparatus of the Present Embodiment)

Figure 1:
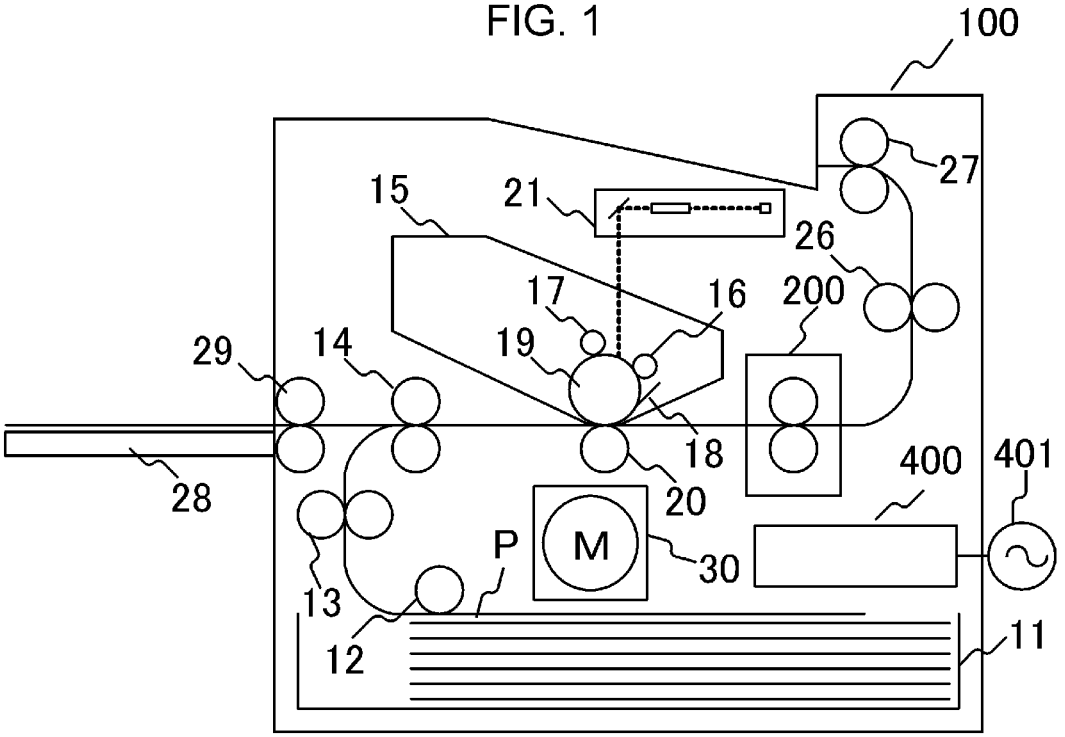
FIG. 1 is a diagram illustrating an image forming apparatus according to an embodiment of the present invention.

FIG. 1 is a schematic cross-sectional view of an image forming apparatus (referred to as a laser printer) 100 that uses an electrophotographic recording technique. Embodiments of an image forming apparatus 100 to which the present invention can be applied include a copying machine, a printer, and the like, that uses an electrophotographic system or an electrostatic recording system. In this example, a case in which the present invention is applied to a laser printer will be discussed.

When a print signal is generated, a scanner unit 21 emits a laser beam modulated according to image information to scan a photosensitive member 19 that is charged to a predetermined polarity by a charging roller 16. In this way, an electrostatic latent image is formed on the photosensitive member 19. Toner is supplied from a developing device 17 to the electrostatic latent image and a toner image corresponding to the image information is formed on the photosensitive member 19. The photosensitive member 19, the charging roller 16, and the developing device 17 are integrated as a process cartridge 15 that includes a toner storage chamber, and are configured to be detachably attached to a main body of the laser printer 100. On the other hand, a recording sheet P as a recording material stacked on a sheet feed cassette 11 is fed by a pickup roller 12 one by one, and is conveyed toward a registration roller 14 by a roller 13. Furthermore, the recording sheet P is conveyed from the registration roller 14 to a transfer position in synchronization with a timing at which the toner image on the photosensitive member 19 reaches the transfer position formed by the photosensitive member 19 and the transfer roller 20. The toner image on the photosensitive member 19 is transferred to the recording sheet P in the course in which the recording sheet P passes the transfer position. After that, the recording sheet P is heated by a fixing apparatus 200 that is an image heating apparatus, as a fixing portion of an image forming apparatus 100, and the toner image is heated and fixed to the recording sheet P. The recording sheet P that bears the toner image fixed thereto is discharged to a tray in an upper part of the laser printer 100 by rollers 26 and 27. Reference numeral 18 is a cleaner that cleans the photosensitive member 19, and reference numeral 28 is a sheet feed tray (a manual tray) having a pair of recording sheet regulating plates of which the width can be adjusted according to the size of the recording sheet P. The sheet feed tray 28 is provided so as to support a recording sheet P having a size other than standard sizes. Reference numeral 29 is a pickup roller that feeds the recording sheet P from the sheet feed tray 28. Reference numeral 30 is a motor that drives the fixing apparatus 200, and the like. Electrical power is supplied from a control circuit 400 connected to a commercial alternating-current power supply 401 to the fixing apparatus 200. The photosensitive member 19, the charging roller 16, the scanner unit 21, the developing device 17, and the transfer roller 20 form an image forming portion that forms a non-fixed image on the recording sheet P.

The laser printer 100 of the present embodiment corresponds to a plurality of recording sheet sizes. Letter sheet (215.9 mm×279.4 mm), Legal sheet (215.9 mm×355.6 mm), and A4 sheet (210 mm×297 mm) can be set on the sheet feed cassette 11. Furthermore, Executive sheet (184.15 mm×266.7 mm), B5 sheet (182 mm×257 mm), and A5 sheet (148 mm×210 mm) can be also set. Moreover, standard sheets, including A6 sheet (105 mm×148 mm) and B6 sheet (128 mm×182 mm), and non-standard sheets, including a DL envelope (110 mm×220 mm) and a COM10 envelope (104.77 mm×241.3 mm), can be fed from the sheet feed tray 28 and printing can be performed thereon. The laser printer 100 of the present embodiment is a laser printer that basically feeds sheets vertically (that is, sheets are conveyed so that the long side is parallel to the conveying direction). Among the widths (referred to as sheet widths) of recording materials printable by the laser printer 100 of the present embodiment, a maximum sheet width is 215.9 mm and a smallest sheet width is 76.2 mm.

A process speed of the laser printer 100 according to the present embodiment is 330 mm/s, and the distance (referred to as an intersheet distance) from a rear end of a sheet having an image formed thereon to a front end of a sheet on which an image is to be formed subsequently is generally 50 mm. For example, when continuous printing is performed on a B5 sheet, a throughput of 64.3 pages per minute (ppm) can be obtained.

Figure 2:
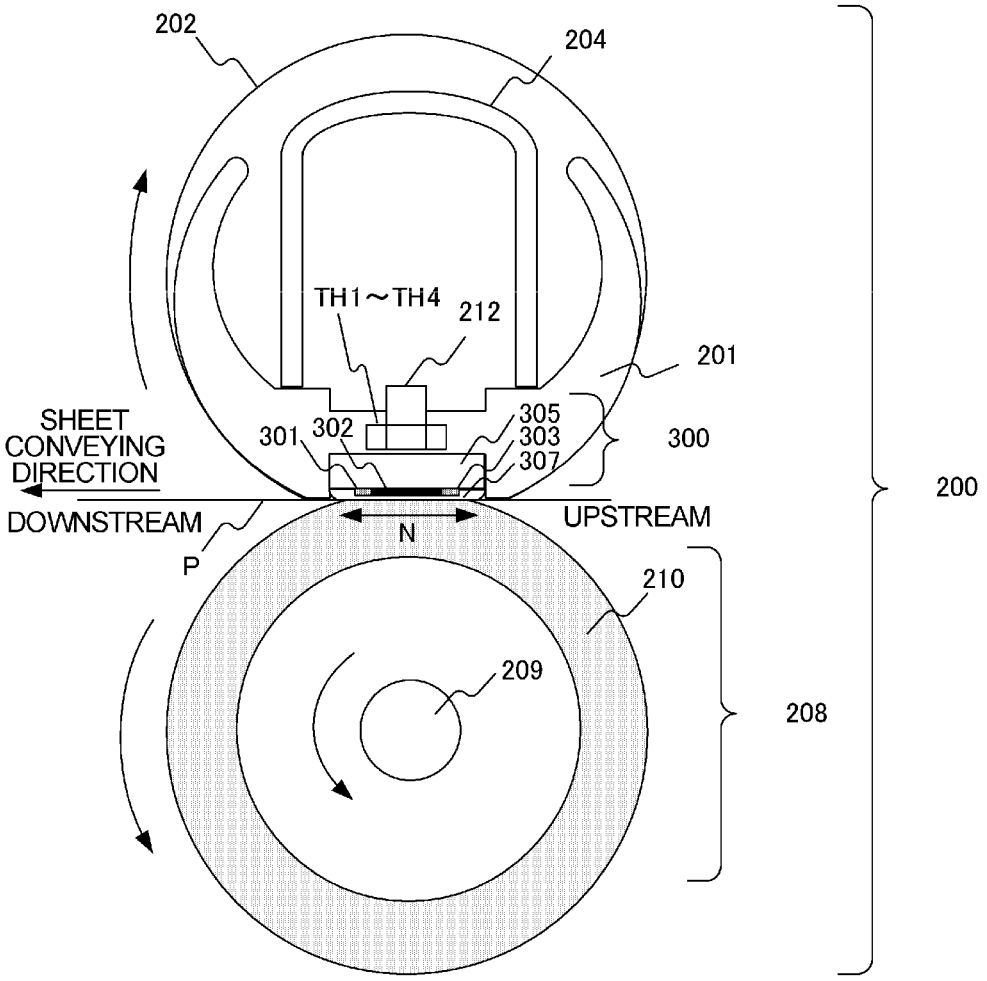
FIG. 2 is a cross-sectional view of a fixing apparatus according to Embodiment 1.

FIG. 2 is a schematic cross-sectional view of the fixing apparatus 200. The fixing apparatus 200 includes a tubular film 202 as a fixing film (also referred to as an endless belt), a heater 300 that makes contact with an inner surface of the film 202, and a pressure roller 208 as a pressure member that faces the heater 300 with the film 202 interposed therebetween. The constituent elements, such as the fixing film 202, the heater 300, and the pressure roller 208, associated with heating of an image formed on these recording materials correspond to an image heating unit of the present invention. In portions in which the heater 300 faces the pressure roller 208, a fixing nip portion N is formed between the film 202 and the pressure roller 208. The material of a base layer of the film 202 is a heat-resistant resin, such as polyimide, or metal, such as stainless steel. Moreover, an elastic layer, such as heat-resistant rubber, may be formed on a surface layer of the film 202. A lubricant (not illustrated) is applied to the inner contact surfaces of the film 202 and the heater 300 in order to improve slidability of both components. The lubricant has such an effect that the lubricant softens with the heat applied from the heater 300 to reduce torque applied to the film 202 and the heater 300. The pressure roller 208 has a core 209 formed of iron, aluminum, or the like, and an elastic layer 210 formed of silicon rubber, or the like. The heater 300 is held by a holding member 201 formed of a heat-resistant resin. The holding member 201 has a guide function of guiding rotation of the film 202. The pressure roller 208 rotates in the direction indicated by an arrow in response to motive power from the motor 30. The film 202 rotates following the rotation of the pressure roller 208. The recording sheet P that bears a non-fixed toner image is heated and fixed using the heat of the heater 300 while being conveyed in a state of being pinched by the fixing nip portion N.

The heater 300 has a configuration in which a conductor 301, a conductor 303, and a heat generating resistor 302 are provided on a ceramic substrate 305. The conductor 301 is provided on the substrate 305 along a heater longitudinal direction. The conductor 303 is provided along the heater longitudinal direction at a different position from the conductor 301 in the heater transverse direction. The temperature coefficient of resistance (TCR) of the heat generating resistor 302 is a positive temperature coefficient, and the heat generating resistor 302 is provided between the conductor 301 and the conductor 303. The heater 300 has a surface protection layer 307 having an insulating property (in the present embodiment, formed of glass) that covers the heat generating resistor 302 and the conductors 301 and 303 described above. Thermistors TH1, TH2, TH3, and TH4, as temperature detection elements, are in contact with a back surface side of the heater substrate 305. A safety element 212, such as a thermo switch or a temperature fuse that operates when the temperature of the heater increases abnormally to cut a power feeding line to a heating region, is also in contact with the back surface side of the heater substrate 305. A stay 204 is a metallic stay for applying pressure of a spring (not illustrated) to the holding member 201.

Figure 3:
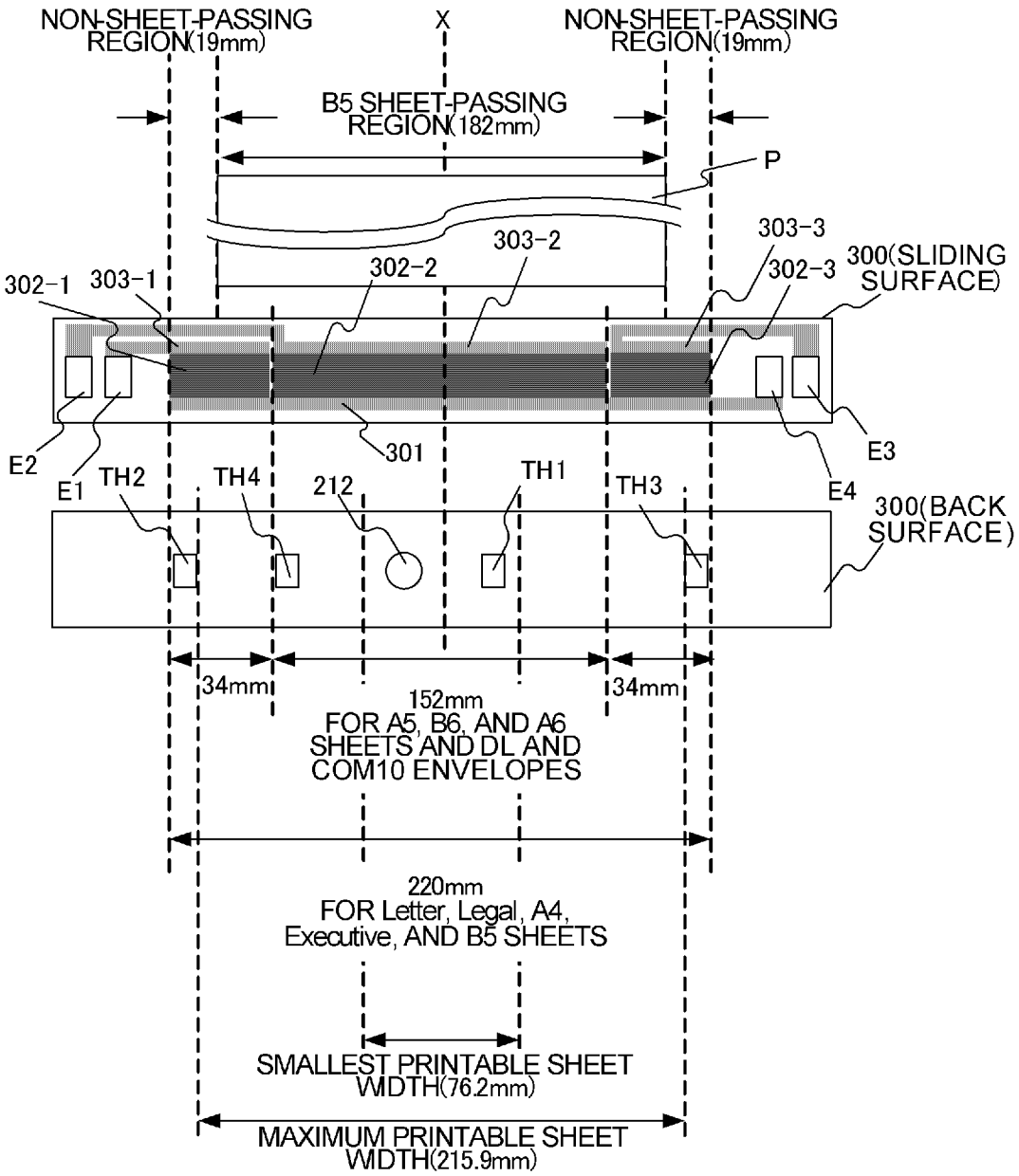
FIG. 3 is a diagram illustrating a configuration of a heater according to Embodiment 1.

FIG. 3 illustrates a diagram illustrating a configuration of the heater 300 according to Embodiment 1, and a case in which a B5 sheet is vertically conveyed in relation to the center of a heating region is illustrated as an example. A reference position when conveying different sheets is defined as a conveying reference position X of recording materials (sheets).

A heat generating resistor of the heater 300 is divided into three heat generating blocks 302-1, 302-2, and 302-3. A width in the longitudinal direction of the heat generating block 302-2 is 152 mm and corresponds to the sheet width of A5 sheet. Moreover, the width in the longitudinal direction of the heat generating blocks 302-1 and 302-3 is 34 mm. The entire width in the longitudinal direction of the three heat generating blocks 302-1, 302-2, 302-3 is 220 mm and corresponds to the sheet width of a Letter sheet. That is, the width of the heater is set to be greater than a maximum printable width (a maximum width in which an image can be formed) so that a fixing process can be performed even when the position of a recording material is shifted in the longitudinal direction. The conductor 301 is provided along the three heat generating blocks 302-1, 302-2, and 302-3 as a conductor A. On the other hand, the conductor 303 is divided into three conductors 303-1, 303-2, and 303-3 as a conductor B, and the respective conductors are provided on the heat generating blocks 302-1, 302-2, and 302-3. E1, E2, E3, and E4 are electrodes used for supplying electrical power to the heater 300. That is, heat generating blocks are made up of a group including the conductors A and B and a heat generating element, and are divided in a longitudinal direction X so that the respective heat generating blocks can be controlled independently. The heat generating element is configured such that the width in a transverse direction Y orthogonal to the longitudinal direction X is constant over the entire region in the longitudinal direction X, and the degree (ratio) of heating between heat generating blocks can be changed by changing the ratio of electrical power in respective heat generating blocks.

The thermistors TH1 to TH4 and the safety element 212 are in contact with the back surface of the heater 300. The temperature of the heater 300 is controlled on the basis of the output of the thermistor TH1. The thermistor TH1 and the safety element 212 are disposed in a region (referred to as a sheet-passing portion) through which a recording material P having a smallest sheet width of 76.2 mm printable by a printer of the present embodiment passes in the longitudinal direction of the fixing nip portion N. The thermistor TH4 detects an edge temperature of the heating region of the heat generating block 302-2, and is disposed at a position corresponding to a non-sheet-passing portion of A5 sheet (sheet width: 148 mm). Moreover, the thermistor TH2 detects an edge temperature of the heating region of the heat generating block 302-1, and the thermistor TH3 detects an edge temperature of the heating region of the heat generating block 302-3. The thermistors TH2 and TH3 are disposed at positions corresponding to a non-sheet-passing portion of a Letter sheet (sheet width: 215.9 mm).

When a B5 sheet having a sheet width of 182 mm is conveyed vertically, a non-sheet-passing portion having a width of 19 mm is formed at both ends in the heating region of the heater 300 in which the heating region has a length of 220 mm. Since the temperature of the heater 300 is controlled on the basis of the output of the thermistor TH1 disposed in the sheet-passing portion and the paper in the non-sheet-passing portion does not deprive heat, the temperature of the non-sheet-passing portion is greater than that of the sheet-passing portion. The TCR of the heat generating blocks 302-1, 302-2, and 302-3 is 1000 ppm/° C., and current flows into the heat generating elements of the heat generating blocks 302-1, 302-2, and 302-3 in the conveying direction of the recording material.

Figure 4:
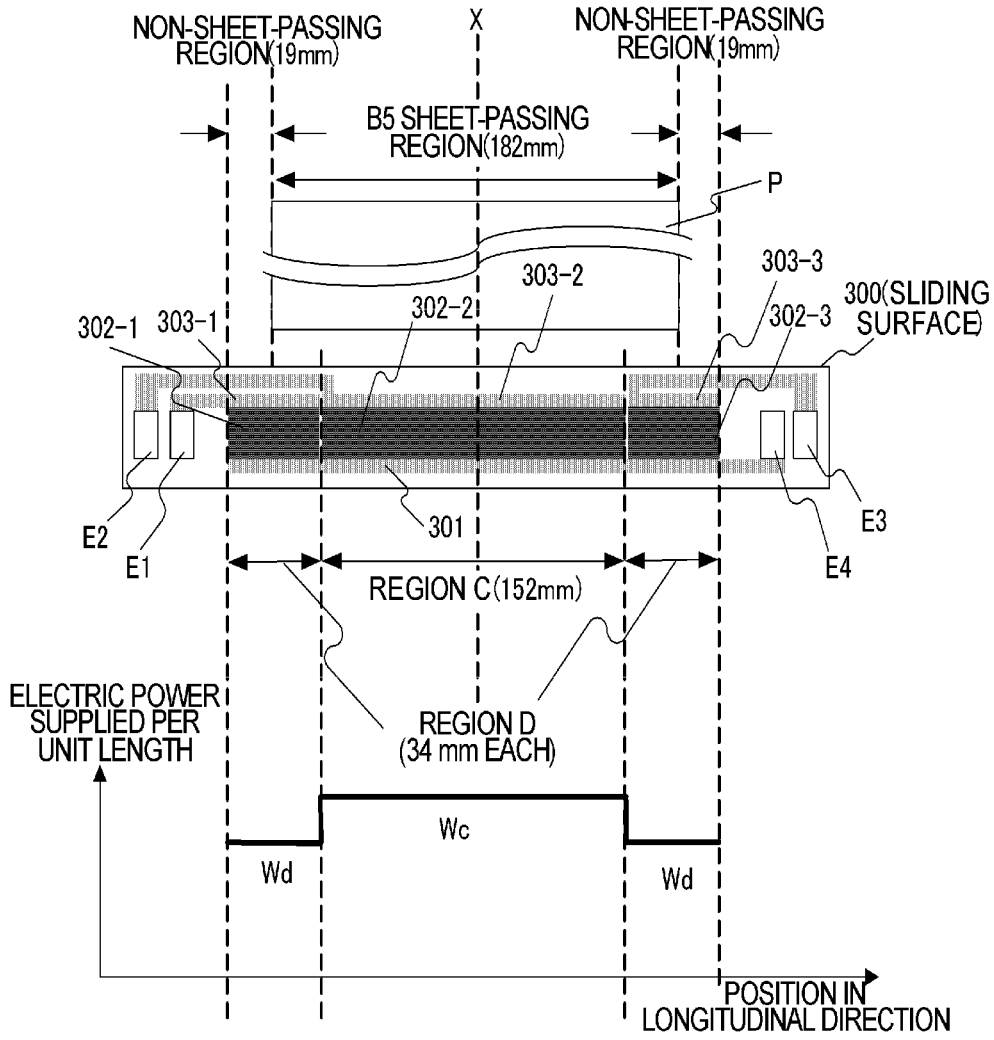
FIG. 4 is a diagram illustrating a relationship between a heat generating block according to Embodiment 1 and electrical power supplied per unit length.

FIG. 4 illustrates the relationship between a heat generating block and electrical power supplied per unit length in the longitudinal direction to each heat generating block according to the present embodiment. The heater 300 of the present embodiment includes the heat generating block 302-2 as a heat generating block C (a second heat generating block). Moreover, the heater 300 of the present embodiment includes the heat generating blocks 302-1 and 302-3 as a heat generating block D (a first heat generating block). Electrical power We per unit length in the heater longitudinal direction is supplied to the heat generating block 302-2 and electrical power Wd is supplied to the heat generating blocks 302-1 and 302-3. The electrical power supplied per unit length in the heater longitudinal direction will be referred to as a unit power in the longitudinal direction.

Figure 5:
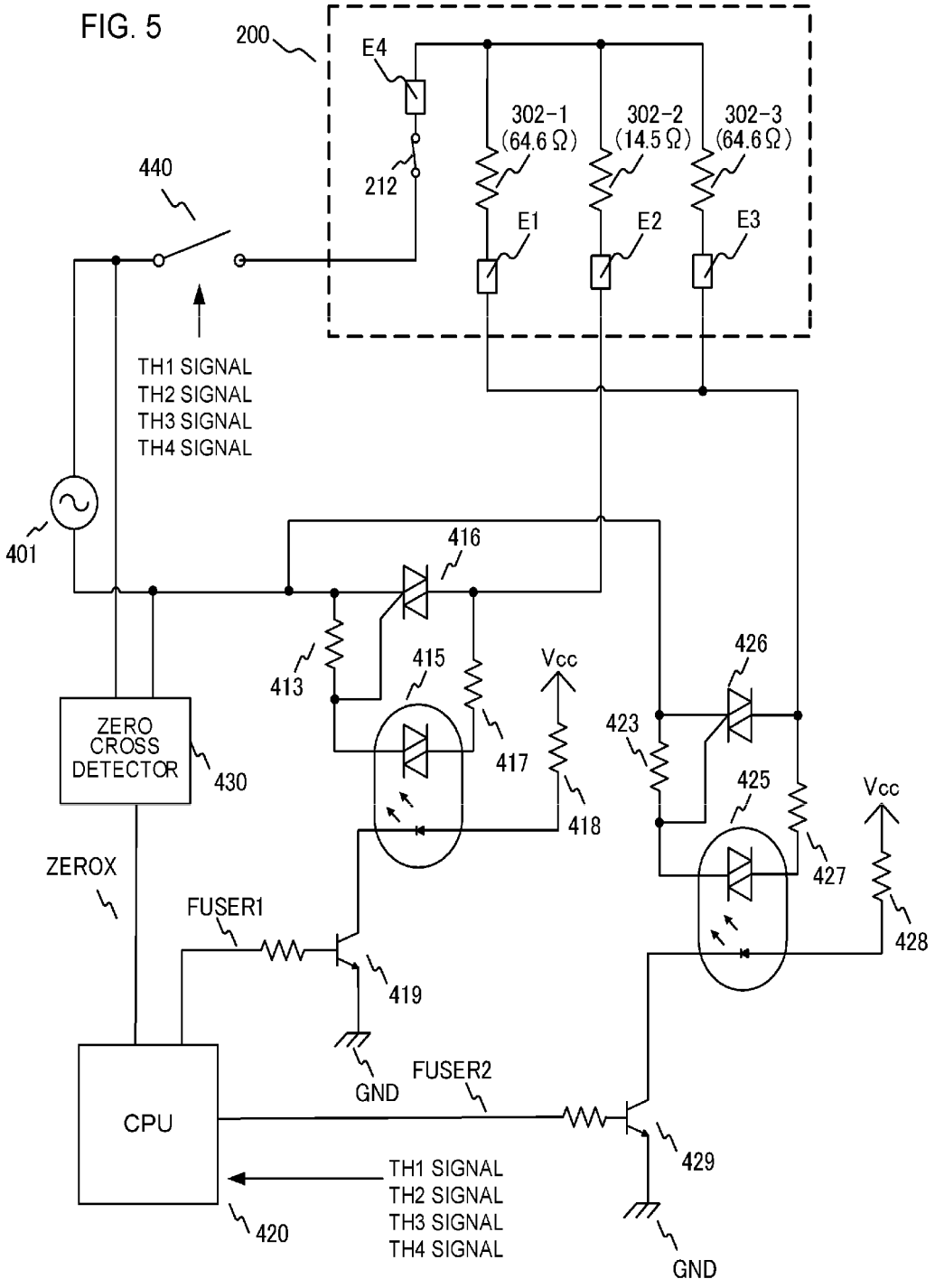
FIG. 5 is a diagram of a heater control circuit according to Embodiment 1.

FIG. 5 illustrates a diagram of a heater control circuit serving as a power control portion according to Embodiment 1. Reference numeral 401 is a commercial alternating-current power supply connected to the laser printer 100. The electrical power supplied to the heater 300 is controlled by energization/de-energization of triacs 416 and 426. Electrical power is supplied to the heater 300 via the electrodes E1 to E4, and, in the present embodiment, the resistance of the heat generating block 302-1 is 64.6Ω, the resistance of the heat generating block 302-2 is 14.5Ω, and the resistance of the heat generating block 302-3 is 64.6Ω.

A zero cross detector 430 is a circuit that detects zero cross of the alternating-current power supply 401 and outputs a signal ZEROX to the CPU 420. The signal ZEROX is used for controlling the heater 300, and a method disclosed in Japanese Patent Application Publication No. 2011-18027 can be used as an example of a zero cross detection circuit. A relay 440 is used as a unit for interrupting the supply of electrical power to the heater 300 when an excessive rise in the temperature of the heater 300 is detected by the thermistors TH1 to TH4 due to a failure, or the like.

The operation of the triac 416 will be described. Resistors 413 and 417 are bias resistors for driving the triac 416, and a phototriac coupler 415 is a device for securing a creepage distance between a primary side and a secondary side. The triac 416 is turned on by energizing a light emitting diode of the phototriac coupler 415. A resistor 418 is a resistor for limiting a current flowing into the light emitting diode of the phototriac coupler 415, and the phototriac coupler 415 is turned on/off by a transistor 419. The transistor 419 operates according to a signal FUSER1 from the CPU 420. When the triac 416 is energized, electrical power is supplied to the heat generating block 302-2 and electrical power is supplied to the resistor of 14.5Ω.

The circuit operation of the triac 426 is the same as the triac 416, and the description thereof will not be provided. That is, resistors 423, 427, and 428 correspond to the resistors 413, 417, and 418, a phototriac coupler 425 corresponds to the phototriac coupler 415, and a transistor 429 corresponds to the transistor 419. The triac 426 operates according to a signal FUSER2 from the CPU 420. When the triac 426 is energized, electrical power is supplied to the heat generating block 302-1 (64.6Ω) and the heat generating block 302-3 (64.6Ω). Since these two heat generating blocks are connected in parallel, electrical power is supplied to a resistor of 32.3Ω.

The temperature detected by the thermistor TH1 is detected in such a way that a voltage divided by a resistor (not illustrated) is detected by the CPU 420 as a TH1 signal. The temperatures detected by the thermistors TH2 to TH4 are detected by the CPU 420 according to a similar method. As for internal processing of the CPU 420, an electrical power to be supplied is calculated, for example, by PI control, on the basis of the temperature detected by the thermistor TH1 and the temperature set to the heater 300. The electrical power is converted to a control level of a phase angle (phase control) or a wave number (wave number control) corresponding to the electrical power to be supplied, and the triacs 416 and 426 are controlled according to the control condition.

The CPU 420 determines whether the temperature of the non-sheet-passing portion has risen on the basis of the temperatures detected by the thermistors TH2 to TH4. Upon detecting an event that the temperature of the thermistor TH2, TH3, or TH4 exceeds a predetermined upper limit THMax, the CPU 420 extends the intersheet distance during printing by 100 mm to realize throughput down. When throughput down is performed in a normal state, the intersheet distance is extended from 50.6 mm to 150.6 mm. In this case, the throughput decreases from 64.3 ppm to 49 ppm for B5 sheets, for example.

(Fixing Apparatus Control Flowchart of Present Embodiment)

Figure 6:
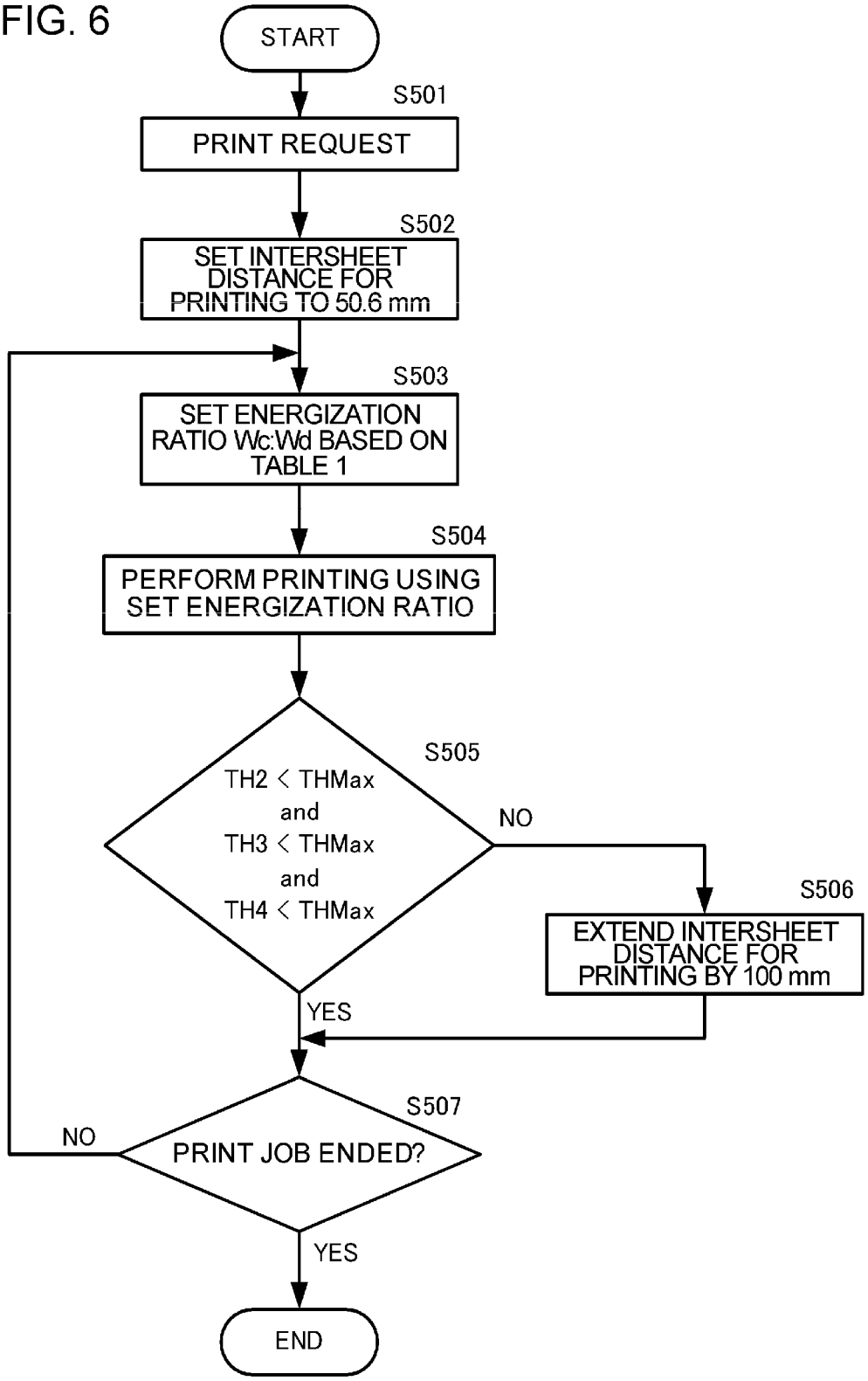
FIG. 6 is a heater control flowchart according to Embodiment 1.

FIG. 6 is a flowchart for describing a sequence for controlling the fixing apparatus 200 by the CPU 420 when the image forming apparatus 100 of the present embodiment performs printing on a recording material P having a sheet width of 152.1 mm or greater. When a print request is issued in S501, an intersheet distance for printing is set to 50.6 mm in S502. In S503, an energization ratio Wc:Wd is set on the basis of a sheet width of the recording material P and the number of passing sheets of a corresponding job. Specifically, the energization ratio is set on the basis of Table 1.

TABLE 1

| | Number of Passing Sheets | | | |
|---|---|---|---|---|
| Sheet Width | Pages 1 to 10 Wc:Wd | Pages 11 to 50 Wc:Wd | Pages 51 to 100 Wc:Wd | Pages 101 onward Wc:Wd |
| 206 mm~215.9 mm | 100:100 | 100:100 | 100:100 | 100:100 |
| 178 mm~205.9 mm | 100:100 | 100:90 | 100:80 | 100:70 |
| 152.1 mm~177.9 mm | 100:100 | 100:80 | 100:70 | 100:60 |

In a recording material having a sheet width of 206 mm to 215.9 mm, described in Table 1, the non-sheet-passing portion is narrow. Due to this, if the electrical power Wd supplied to the heat generating blocks 302-1 and 302-3 is set to be less than the electrical power Wc supplied to the heat generating block 302-2, the temperature near edges in the longitudinal direction of the recording material may decrease and fixing faults may occur. Therefore, the energization ratio is controlled to 100:100 regardless of the number of passing sheets.

In the recording materials having the sheet widths of 152.1 mm to 177.9 mm and 178 mm to 205.9 mm described in Table 1, the temperature difference between a sheet-passing portion and a non-sheet-passing portion is small for pages 1 to 10 of the continuous printing. Due to this, since fixing faults may occur near the edges in the longitudinal direction of the recording material if the electrical power Wd is decreased from the first page of the continuous printing, the energization ratio is controlled to Wc:Wd=100:100 for pages 1 to 10. Since the temperature difference between the sheet-passing portion and the non-sheet-passing portion increases gradually from the eleventh page of the continuous printing, the heat of the non-sheet-passing portion spreads to the sheet-passing portion. Therefore, even when the electrical power Wd is set to be less than the electrical power Wc, since it is possible to secure a fixing property near the edges in the longitudinal direction of the recording material, the ratio Wd/Wc of the electrical power Wd to the electrical power Wc is decreased. In the present embodiment, the decrease in the electrical power Wd is gradually increased as the number of passing sheets increases within a range in which fixing faults do not occur. Moreover, since the width of the non-sheet-passing portion increases as compared to the sheet-passing portion as the sheet width decreases, the rise in the temperature of the non-sheet-passing portion increases. Due to this, the ratio Wd/Wc of the electrical power Wd to the electrical power Wc for the recording material having the sheet width of 152.1 mm to 177.9 mm is less than that of the recording material having the sheet width of 178 mm to 205.9 mm.

In S504, printing is performed using the set energization ratio and the intersheet distance set in S502 or S506. In S505, it is determined whether the temperature detected by any one of the thermistors TH2, TH3, and TH4 exceeds the maximum temperature THMax set by the CPU 420. When the temperature of any one of the thermistors TH2, TH3, and TH4 does not exceed the maximum temperature THMax, it is determined in S507 whether a print job has ended. The flow proceeds to S503 when the print job has not ended. When the temperature of any one of the thermistors TH2, TH3, and TH4 exceeds the maximum temperature THMax, the flow proceeds to S506 and the intersheet distance is extended by 100 mm. For example, when printing is performed on B5 sheets using a normal intersheet distance, a throughput down from 64.3 ppm to 49 ppm is realized. After that, it is determined in S507 whether the print job has ended, and the flow proceeds to S503 when the print job has not ended. These processes are performed repeatedly, and, when the end of the print job is detected in S507, the image forming control sequence ends.

(Verification of Advantages of Present Embodiment)

Figure 23:
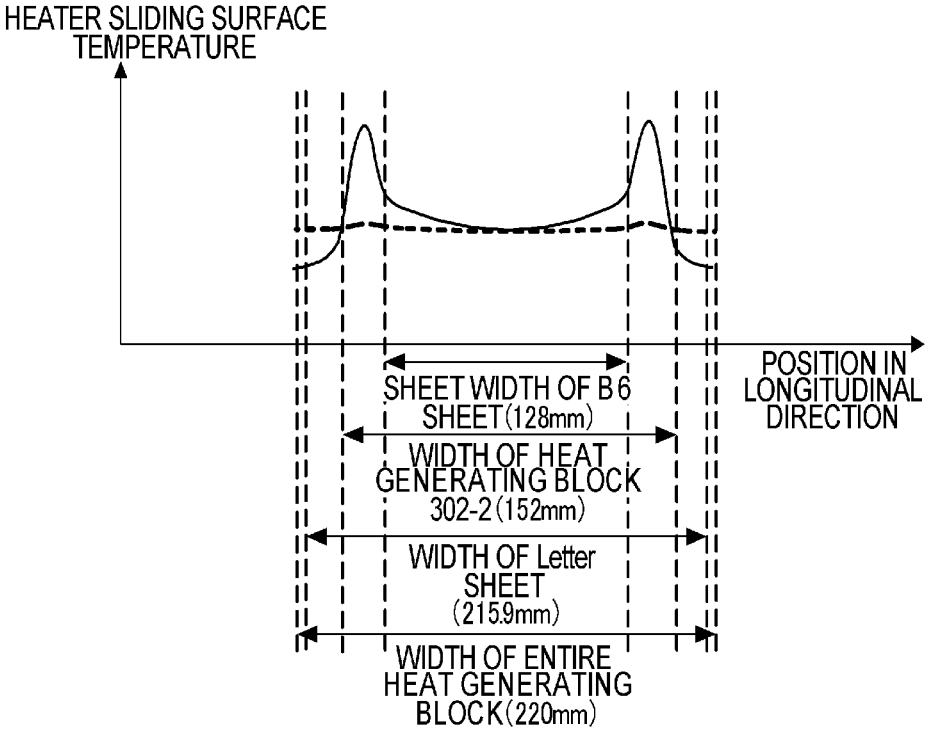
FIG. 23 is a diagram illustrating a longitudinal temperature distribution on a heater sliding surface after continuous printing is performed on a B6 sheet according to the conventional control.

First, problems to be solved by the present invention will be described in detail again with reference to FIG. 23. A solid-line graph in FIG. 23 plots a temperature distribution on a heater sliding surface immediately after printing is performed on a B6 sheet using the fixing apparatus mounted with the heater illustrated in FIG. 2. When continuous printing is performed on a recording material having a smaller width than the width in the longitudinal direction of the heat generating block 302-2 at the center, the temperature of the non-sheet-passing portion of the heat generating block 302-2 at the center increases. Moreover, when the heat generating blocks 302-1 and 302-3 at both ends are not heated, a temperature difference between the region of the heat generating blocks 302-1 and 302-3 and the heat generating block 302-2 at the center increases. Therefore, the temperature distribution in the longitudinal direction becomes non-uniform.

A broken-line graph in FIG. 23 plots a temperature distribution when a standby period for uniformizing the temperature in the longitudinal direction is provided. The broken-line graph in FIG. 23 plots a temperature distribution in the longitudinal direction of the heater sliding surface when a predetermined standby period is provided after printing is performed on B6 sheet. The temperature is uniform in the longitudinal direction, and even when printing is performed on Letter sheet, for example, in this state, high-temperature offsets or fixing faults do not occur. Such a standby period is, however, disadvantageous to users.

Figures 7A, 7B, 7C:
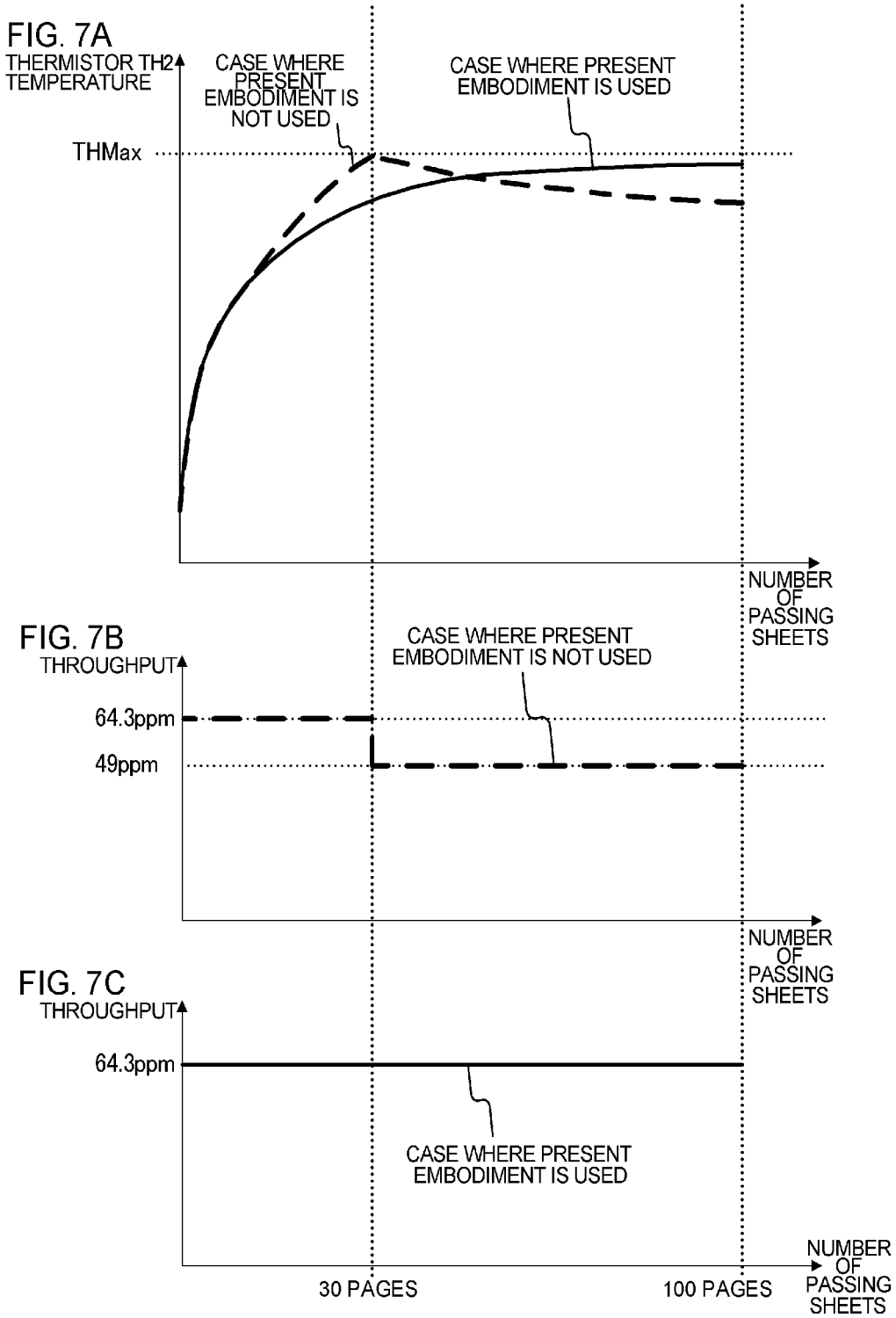
FIGS. 7A to 7C are diagrams illustrating changes in a temperature rise in a non-sheet-passing portion and a throughput when control of Embodiment 1 is used.

FIGS. 7A to 7C illustrate changes in the temperature of the thermistor TH2 and changes in the throughput when the control of the fixing device of the present embodiment is used and when the control of the fixing apparatus is not used. FIG. 7A illustrates a change in the temperature of the thermistor TH2 when one-hundred pages of the B5-size recording material P have passed. A dot-line graph plots the change when the control of the fixing apparatus of the present embodiment is not used and a solid-line graph plots the change when the control of the fixing device of the present embodiment is used. The case in which the control of the fixing apparatus according to the present embodiment is not used is a case in which the energization ratio Wc:Wd is 100:100 when the sheet width is 152.1 mm or greater.

When the control of the present embodiment is not used, the temperature exceeds the maximum temperature THMax of the thermistor TH2 when the number of passing sheets reaches thirty pages. Due to this, as illustrated in FIG. 7B, the throughput decreases from 64.3 ppm to 49 ppm when the number of passing sheets reaches thirty pages. When the control of the present embodiment is used, as illustrated in FIG. 7C, since the temperature does not exceed the maximum temperature THMax of the thermistor TH2 when printing is performed on one-hundred pages, the throughput remains at 64.3 ppm.

As described above, when the control of the fixing device of the present embodiment is used, it is possible to maximize the throughput during printing by decreasing the electrical power Wd in relation to the electrical power Wc.

Embodiment 2

Next, Embodiment 2, in which the heater control circuit in the fixing apparatus of the laser printer 100 and a control method thereof are changed, will be described. Embodiment 2 is different from Embodiment 1 in that electrical power to be supplied to the three heat generating blocks can be controlled independently and the energization ratios are controlled on the basis of the temperature detected by the thermistor of the heat generating block in a corresponding job. Description of constituent elements similar to those of Embodiment 1 will not be provided.

The arrangement of the thermistors TH1, TH2, TH3, and TH4 of the present embodiment is similar to that of Embodiment 1 and is illustrated in FIG. 3. The temperature of the heater 300 is controlled on the basis of the output of the thermistor TH1. The thermistor TH4 detects an edge temperature of the heating region of the heat generating block 302-2 and is disposed at a position corresponding to a non-sheet-passing portion of A5 sheet (sheet width: 148 mm). Moreover, the thermistor TH2 detects an edge temperature of the heating region of the heat generating block 302-1, and the thermistor TH3 detects an edge temperature of the heating region of the heat generating block 302-3. The thermistors TH2 and TH3 are disposed at positions corresponding to a non-sheet-passing portion of Letter sheet (sheet width: 215.9 mm).

Figure 8:
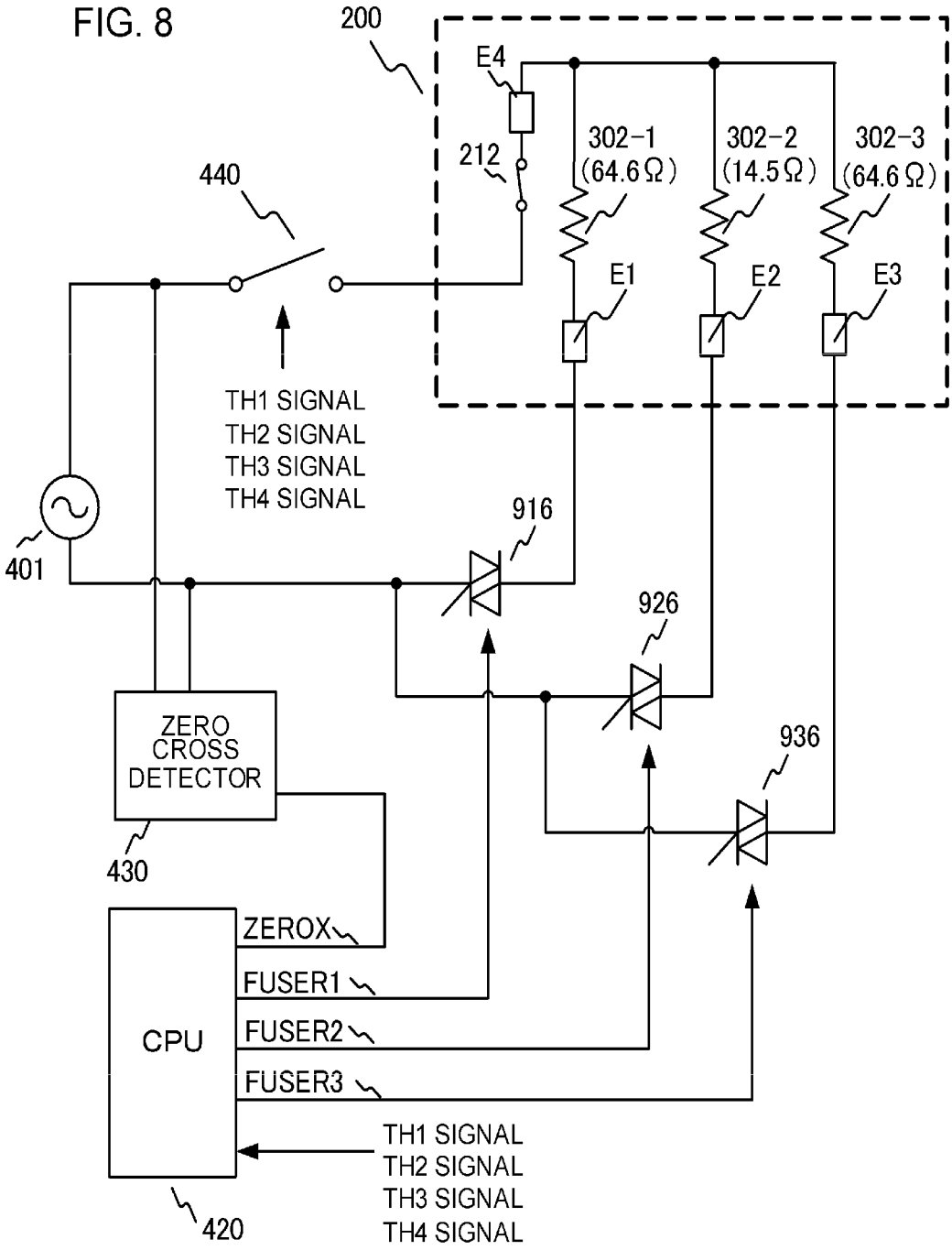
FIG. 8 is a diagram of a heater control circuit according to Embodiment 2.

FIG. 8 illustrates a diagram of a heater control circuit according to Embodiment 2. Embodiments 1 and 2 are different in that two triacs are provided in Embodiment 1 whereas three triacs are provided in Embodiment 2. The electrical power supplied to the heater 300 is controlled by energization/de-energization of triacs 916, 926, and 936. When the triacs 916, 926, and 936 are energized, electrical power is supplied to the heat generating blocks 302-1, 302-2, and 302-3, respectively. Since the circuit operation of the triacs 916, 926, and 936 is similar to that of the triac 416 of Embodiment 1, the description thereof will not be provided. The driving circuits of the respective triacs are not illustrated in FIG. 8. As used in this description, a unit power in the longitudinal direction to be supplied to the heat generating block 302-1 will be referred to as WdL, a unit power in the longitudinal direction to be supplied to the heat generating block 302-3 will be referred to as WdR, and a unit power in the longitudinal direction to be supplied to the heat generating block 302-2 will be referred to as Wc. In the present embodiment, the electrical power to be supplied to the heat generating blocks 302-1 to 302-3 can be controlled independently.

The energization ratio Wc:WdL is changed gradually on the basis of the temperature detected by the thermistor TH2, and the energization ratio Wc:WdR is changed gradually on the basis of the temperature detected by the thermistor TH3. As illustrated in Table 2, the level XL of the energization ratio Wc:WdL includes four levels, namely, level 1 to level 4, and similarly, the level XR of the energization ratio Wc:WdR includes four levels, namely, level 1 to level 4. The level XL is changed when the temperature detected by the thermistor TH2 exceeds a threshold THW. The level XR is changed when the temperature detected by the thermistor TH3 exceeds the threshold THW. The threshold THW corresponding to level 1 is a threshold THW1, the threshold THW corresponding to level 2 is a threshold THW2, and the threshold THW corresponding to level 3 is a threshold THW3. When the temperature detected by the thermistor TH2 or TH3 exceeds the threshold THW (THW1 or THW2 or THW3) set to a lower value than THMax, the CPU 420 changes the level XL or XR so that the ratio WdL/Wc or WdR/Wc of the electrical power WdL or WdR to the electrical power Wc decreases.

TABLE 2

| | Energization Ratio Levels XL and XR | | | |
|---|---|---|---|---|
| | Level 1 | Level 2 | Level 3 | Level 4 |
| Wc:WdL and Wc:WdR | 100:100 | 100:90 | 100:80 | 100:70 |
| THW | THW1 | THW2 | THW3 | None |

Figure 9:
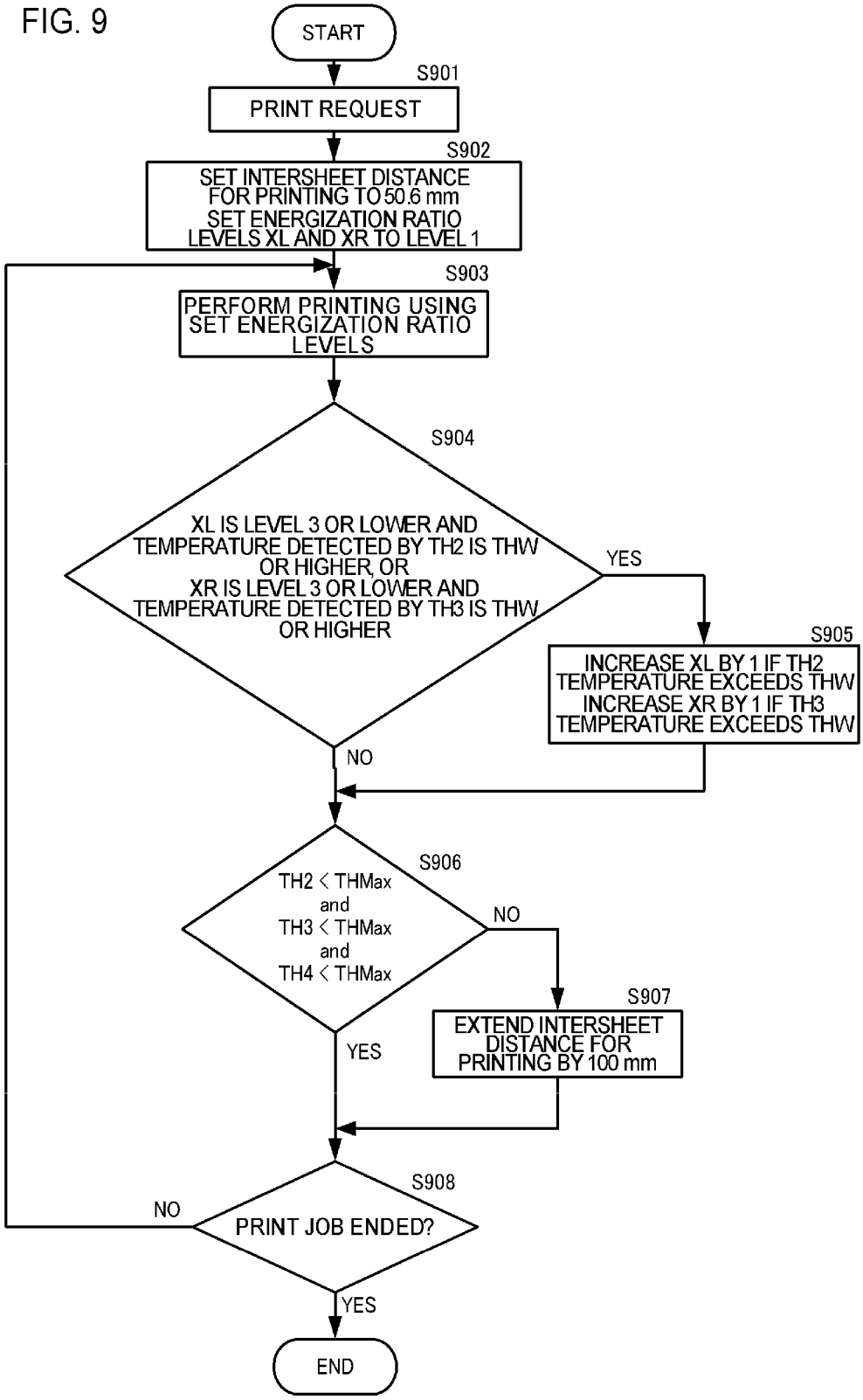
FIG. 9 is a heater control flowchart according to Embodiment 2.

FIG. 9 is a flowchart for describing a sequence for controlling the fixing apparatus 200 by the CPU 420 when the image forming apparatus 100 of the present embodiment performs printing on a recording material P having a sheet width of 152.1 mm or greater. When a print request is issued in S901, in S902, an intersheet distance for printing is set to 50.6 mm and the energization ratio levels XL and XR are set to level 1. In S903, the energization ratio corresponding to the set energization ratio level XL or XR is determined on the basis of Table 2, and printing is performed using the intersheet distance set in S902 or S907.

In Table 2, the energization ratio level is switched whenever the thermistor TH2 or TH3 exceeds the threshold THW. The determination of the energization ratio levels for the left and right heat generating blocks 302-1 and 302-3 is performed independently. Due to this, even when the conveying position of a recording material is shifted in a heater longitudinal direction in relation to a conveying reference position of the recording material and the temperatures of the non-sheet-passing portions of the heat generating blocks 302-1 and 302-3 are different (referred to as a lateral difference), the energization ratio can be controlled in the direction of cancelling the difference.

When the thermistor TH2 exceeds the threshold THW, the energization ratio of the heat generating block 302-1 to the heat generating block 302-2 is decreased. On the other hand, when the thermistor TH3 exceeds the threshold THW, the energization ratio of the heat generating block 302-3 to the heat generating block 302-2 is decreased. The threshold THW is set for respective energization ratio levels such that THW1 is set to level 1, THW2 is set to level 2, and THW3 is set to level 3. The thresholds THW1, THW2, THW3, and THMax are in such a magnitude relationship that THW1<THW2<THW3<THMax.

In S904, when XL is level 3 or lower and the temperature detected by the thermistor TH2 is THW or greater, or when XR is level 3 or lower and the temperature detected by the thermistor TH3 is THW or greater, the flow proceeds to S905. If NO is obtained in S904, the flow proceeds to S906. In S905, when the temperature detected by the thermistor TH2 is THW or greater, XL is increased by 1. When the temperature detected by the thermistor TH3 is THW or greater, XR is increased by 1. In S906, it is determined whether the temperature detected by any one of the thermistors TH2, TH3, and TH4 exceeds the maximum temperature THMax set by the CPU 420. When the detected temperature does not exceed the maximum temperature, it is determined in S908 whether the print job has ended. When the print job has not ended, the flow proceeds to S903. When the detected temperature exceeds the maximum temperature, the flow proceeds to S907 and the intersheet distance is extended by 100 mm. For example, when printing is performed on B5 sheets using a normal intersheet distance, a throughput down from 64.3 ppm to 49 ppm is realized. After that, it is determined in S908 whether the print job has ended, and the flow proceeds to S903 when the print job has not ended.

As an example of the processes S903 to S908, a case in which continuous printing is performed in the state of the energization ratio 100:100, starting from the energization ratio level 1 for the first page of continuous printing, will be described. When the temperature detected by the thermistor TH2 or TH3 exceeds the threshold THW1, the energization ratio level XL or XR of a heat generating block in which the thermistor is disposed is changed to level 2. In energization ratio level 2, continuous printing is performed by changing the energization ratio Wc:Wd to 100:90. After that, when the temperature detected by the thermistor TH2 or TH3 exceeds the threshold THW2, the energization ratio level XL or XR is changed gradually to level 3. Moreover, when the detected temperature exceeds the threshold THW3, the energization ratio level XL or XR is changed gradually to level 4.

The above-described processes are repeatedly performed, and, when the end of the print job is detected in S908, the print control sequence ends.

(Verification of Advantages of Present Embodiment)

As a verification of advantages of the present invention, a case in which printing was performed on one hundred pages of B5-size recording materials P in a state in which the central position in the longitudinal direction of a recording material is shifted toward the heat generating block 302-3 in relation to the conveying reference position X will be described.

Figure 10A:
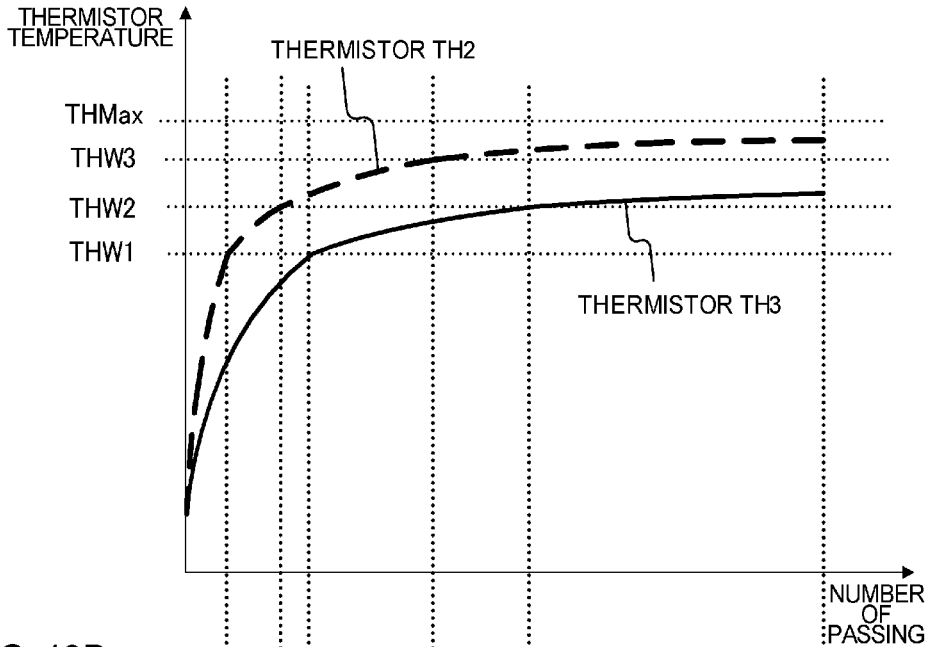
FIGS. 10A to 10C are diagrams illustrating changes in a temperature rise in a non-sheet-passing portion and a throughput when control of Embodiment 2 is not used.

FIG. 10A illustrates a change in the temperature of the thermistors TH2 and TH3 according to the present embodiment. A broken-line graph plots the temperature detected by the thermistor TH2, and a solid-line graph plots the temperature detected by the thermistor TH3. Since the central position in the longitudinal direction of a recording material is shifted toward the heat generating block 302-3, the length of the non-sheet-passing portion close to the heat generating block 302-1 increases and the length of the non-sheet-passing portion close to the heat generating block 302-3 decreases. Due to this shift, the temperature detected by the thermistor TH2 rises more quickly than the temperature detected by the thermistor TH3.

Figure 10B:
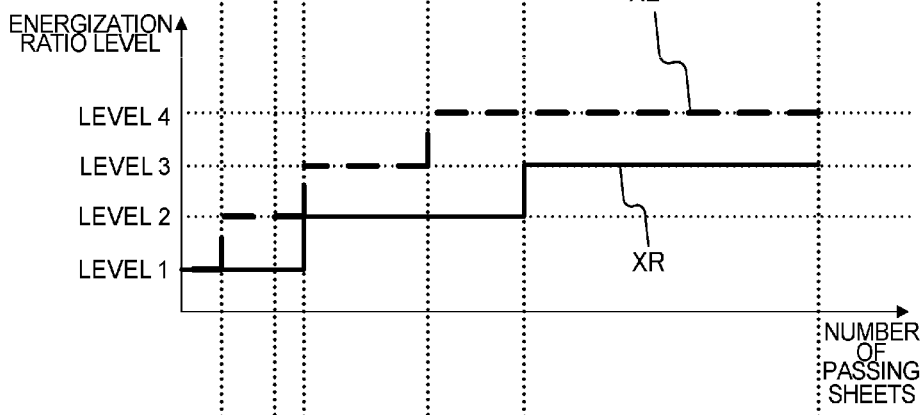
Figure 10C:
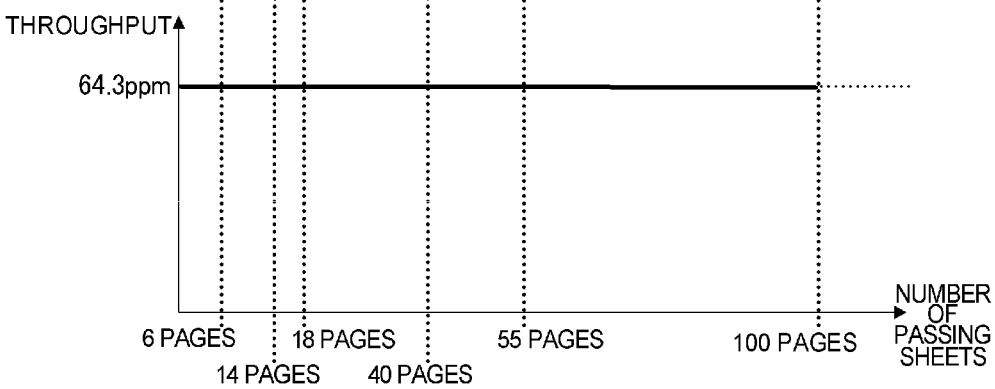

FIG. 10B illustrates the changes in the energization ratio levels XL and XR by broken and solid-line graphs, respectively. In the present embodiment, the energization ratio levels XL and XR are controlled on the basis of the temperatures detected by the thermistors TH2 and TH3, respectively. In this case, the temperature detected by the thermistor TH2 exceeds the threshold THW1 and the energization ratio level is switched to level 2 when the number of passing sheets reaches ten pages. Since the energization ratio level XL increases whenever the temperature detected by the thermistor TH2 exceeds the thresholds THW2 and THW3, an increase in the temperature detected by the thermistor TH2 decreases. Due to this, the temperatures detected by the thermistors TH2 and TH3 did not exceed the maximum temperature THMax even after the number of passing sheets exceeded one hundred pages. As illustrated in FIG. 10C, the throughput remains at 64.3 ppm until the number of passing sheets reaches one hundred pages.

Figure 11A:
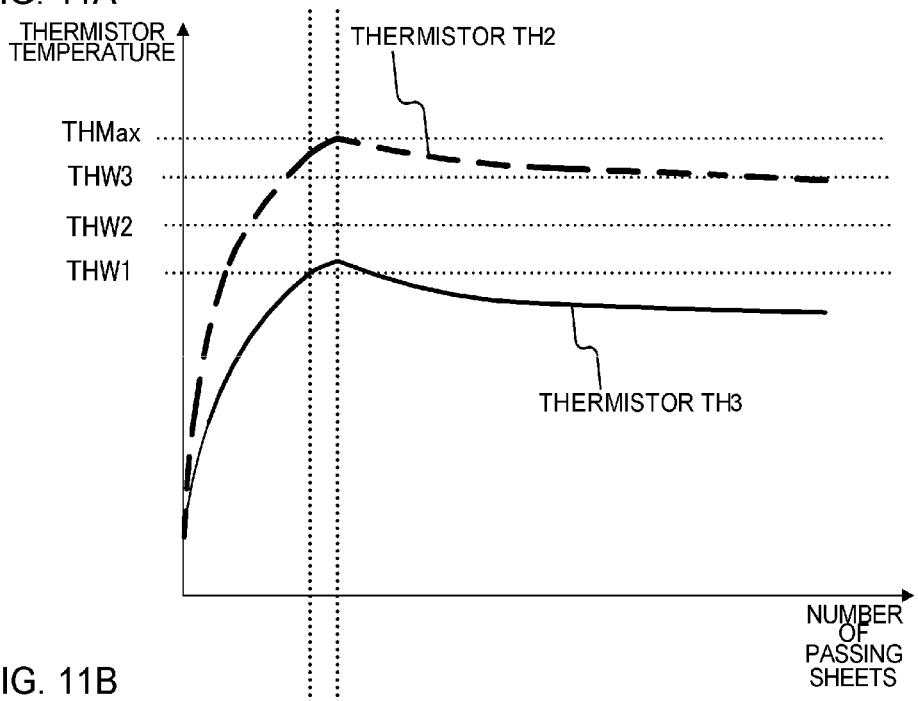
FIGS. 11A to 11C are diagrams illustrating changes in a temperature rise in a non-sheet-passing portion and a throughput when control of Embodiment 2 is used.
Figure 11B:
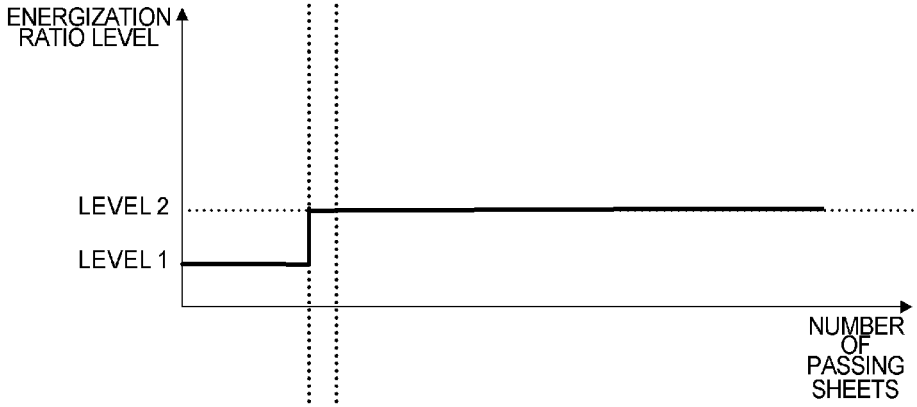
Figure 11C:
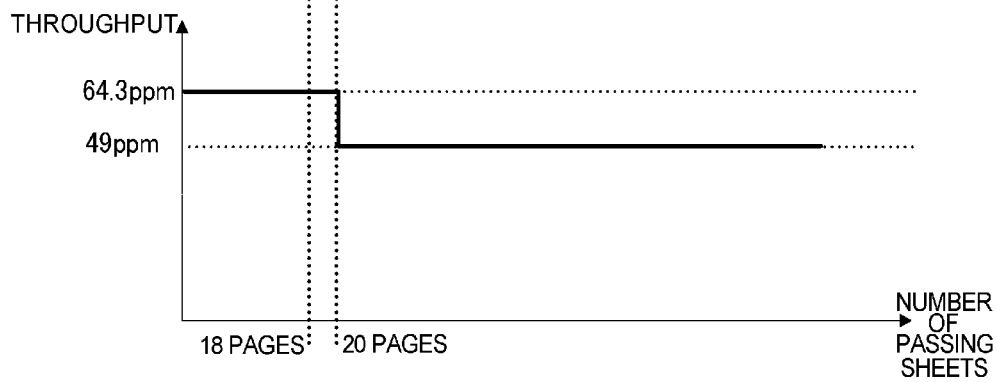

FIGS. 11A to 11C illustrate a change in the temperature of the thermistors TH2 and TH3 and the change in the throughput when the heat generating blocks 302-1 and 302-3 are not controlled independently as a Comparative Example to the present embodiment. FIG. 11A illustrates a change in the temperature of the thermistors TH2 and TH3 according to the Comparative Example. A broken-line graph plots the temperature detected by the thermistor TH2 and a solid-line graph plots the temperature detected by the thermistor TH3. FIG. 11B illustrates a change in the energization ratio level. In the Comparative Example, the energization ratio is controlled on the basis of the lower temperature detected by the two thermistors in order to secure a fixing property near the edges in the longitudinal direction of a recording material. In this case, the temperature detected by the thermistor TH3 exceeds the threshold THW1 and the energization ratio level is switched to level 2 when the number of passing sheets reaches eighteen pages. The temperature detected by the thermistor TH2 rises near THMax when the number of passing sheets reaches eighteen pages and exceeds the maximum temperature THMax of the thermistor TH2 when the number of passing sheets reaches twenty pages. Due to this temperature change, as illustrated in FIG. 11C, the throughput has decreased from 64.3 ppm to 49 ppm when the number of passing sheets reaches twenty pages.

As described above, in the present embodiment, electrodes are provided in the heat generating blocks 302-1 and 302-3, the electrostatic latent images of the respective heating regions are detected by the thermistor TH2 or TH3, and the energization ratio is controlled on the basis of the detected temperature. Due to this arrangement, even when the conveying reference position X of the recording material is shifted in the longitudinal direction and the temperatures of the non-sheet-passing portions of the left and right heat generating blocks are different, it is possible to maintain a printing throughput.

Embodiment 3

In Embodiment 3, a control method, in which the temperature in the longitudinal direction of a heater is uniformized quickly after a print job is executed using the heater in which the heat generating block is divided into seven blocks in the heater longitudinal direction to thereby shorten the standby period to subsequent printing, will be described. The description of constituent elements similar to those of Embodiment 1 will not be provided.

Figure 12:
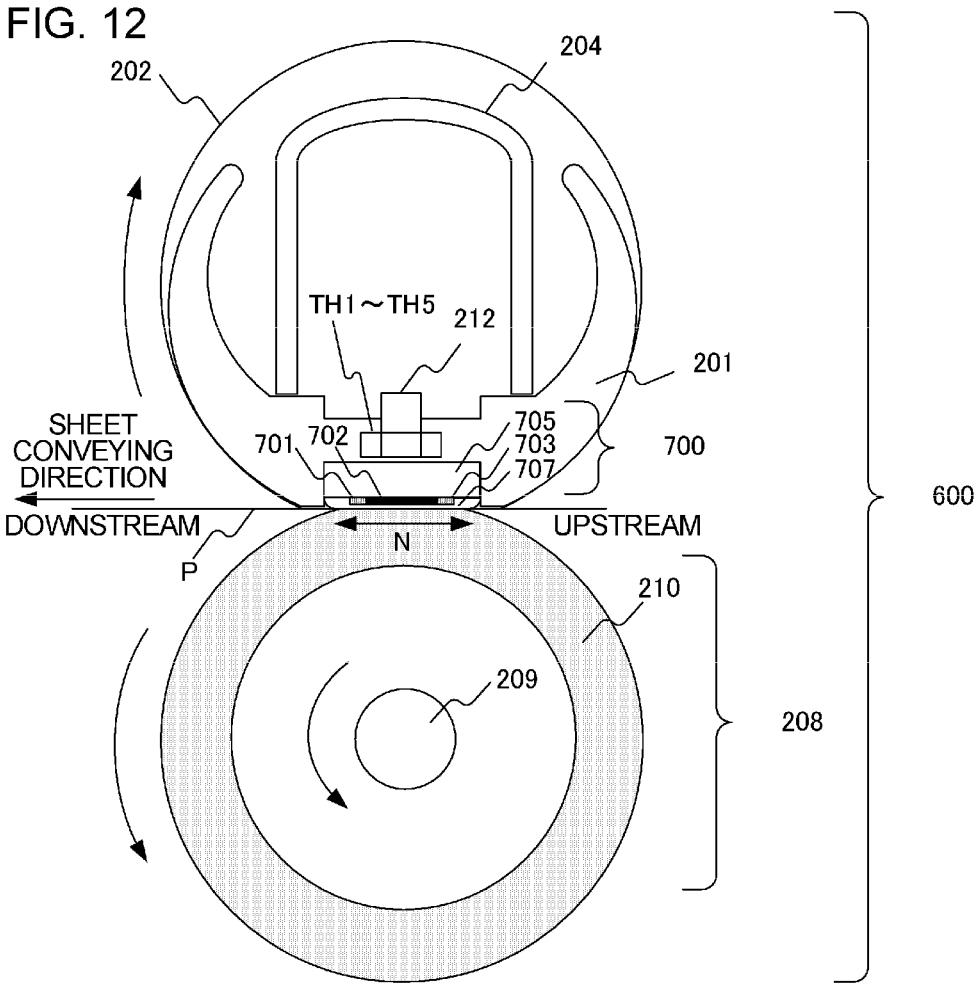
FIG. 12 is a cross-sectional view of a fixing apparatus according to Embodiment 3.

A heater 700 is mounted in a fixing apparatus 600 illustrated in FIG. 12. The heater 700 has a configuration in which a conductor 701, a conductor 703, and a heat generating resistor 702 are provided on a ceramic substrate 705. The conductor 701 is provided along the longitudinal direction of the substrate 705 as a conductor A. The conductor 703 is provided along the longitudinal direction of the substrate 705 at a different position in the transverse direction of the substrate 705 from the conductor 701 as a conductor B. The heat generating resistor 702 has a positive TCR and is provided between the conductor 701 and the conductor 703 as a heat generating element. Moreover, the heater 700 has a surface protection layer 707 having an insulating property, and covering the heat generating element 702 and the conductors 701 and 703.

Figure 13:
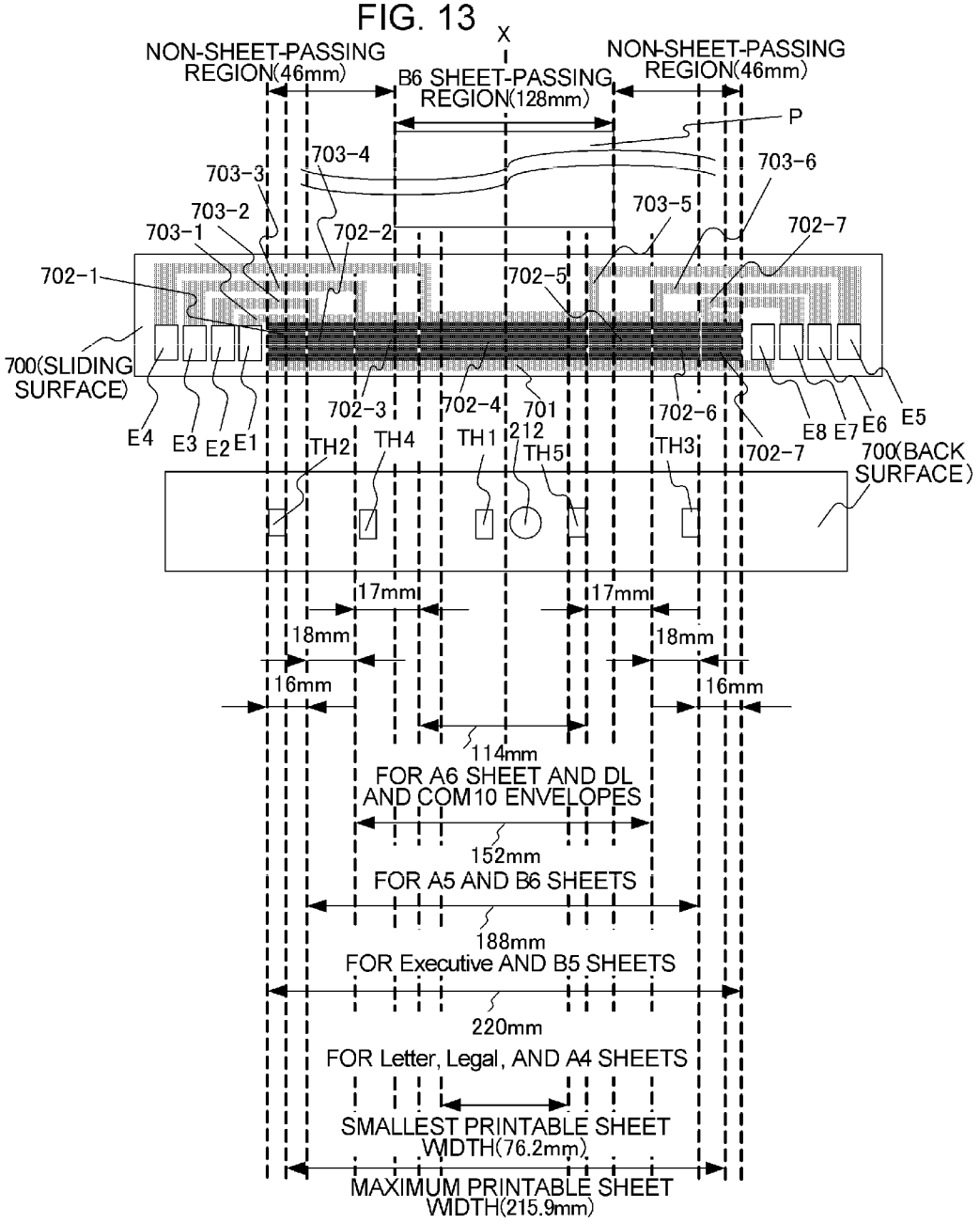
FIG. 13 is a diagram illustrating a configuration of a heater according to Embodiment 3.

FIG. 13 illustrates a configuration of the heater 700 according to the present embodiment and an arrangement of thermistors and a safety element, and illustrates an example in which B6 sheets (128 mm×182 mm) as the recording material P are conveyed vertically about the center in the longitudinal direction of the heating region. The heat generating element 702 is divided into seven heat generating blocks 702-1 to 702-7 and a material having a TCR of 1000 ppm/° C. is used.

An entire range in which the heat generating block 702-4 as a heat generating block C (a second heat generating block) is provided is a range in which the recording material P passes. In the present embodiment, the length of a forming region of the heat generating block 702-4 is set to 114 mm.

Only a portion of a range in which the heat generating blocks 702-3 and 702-5 as a heat generating block D (a first heat generating block) are provided is the range in which the recording material P passes. In the present embodiment, the length of the forming region of the heat generating blocks 702-3 to 702-5 is set to 152 mm, and the left and right edges of a B6 sheet pass positions 12 mm inward from the ends of the heat generating blocks 702-3 and 702-5 when the B6 sheet was conveyed.

The heat generating blocks 702-2 and 702-6, as a heat generating block E (a third heat generating block), are heat generating blocks disposed adjacent to the heat generating block D. The length of the forming region of the heat generating blocks 702-2 to 702-6 is set to 188 mm.

The heat generating blocks 702-1 and 702-7, as a heat generating block F (a fourth heat generating block), are heat generating blocks disposed on the outer side of the heat generating block E. These heat generating blocks 702-1 and 702-7 are positioned on the outermost side among the heat generating blocks in the sheet-passing region when a B6 sheet was conveyed. The length of the forming region of the heat generating blocks 702-1 to 702-7 is set to 220 mm.

The respective heat generating blocks generate heat by being energized via the electrodes E1 to E8 and the conductors 701 and 703 from a heater control circuit, to be described later.

Thermistors TH1 to TH5 and the safety element 212 are disposed on the back surface of the heater 700. The thermistor TH1 and the safety element 212 are disposed in a sheet-passing region of the recording material P having a width of 76.2 mm that is a smallest sheet-passing size. The temperature of the heater 700 is controlled on the basis of the output of the thermistor TH1. The thermistor TH5 detects the edge temperature of the heating region of the heat generating block 702-4 and is disposed at a position corresponding to a non-sheet-passing portion of a DL envelope (sheet width: 110 mm). Moreover, the thermistor TH4 detects the edge temperature of the heating region of the heat generating block 702-3 and is disposed at a position corresponding to a non-sheet-passing portion of an A5 sheet (sheet width: 148 mm). Furthermore, the thermistor TH3 detects the edge temperature of the heating region of the heat generating block 702-6 and is disposed at a position corresponding to a non-sheet-passing portion of an Executive sheet (sheet width: 184.15 mm). Furthermore, the thermistor TH2 detects the edge temperature of the heating region of the heat generating block 702-1 and is disposed at a position corresponding to a non-sheet-passing portion of Letter sheet (sheet width: 215.9 mm).

Figure 14:
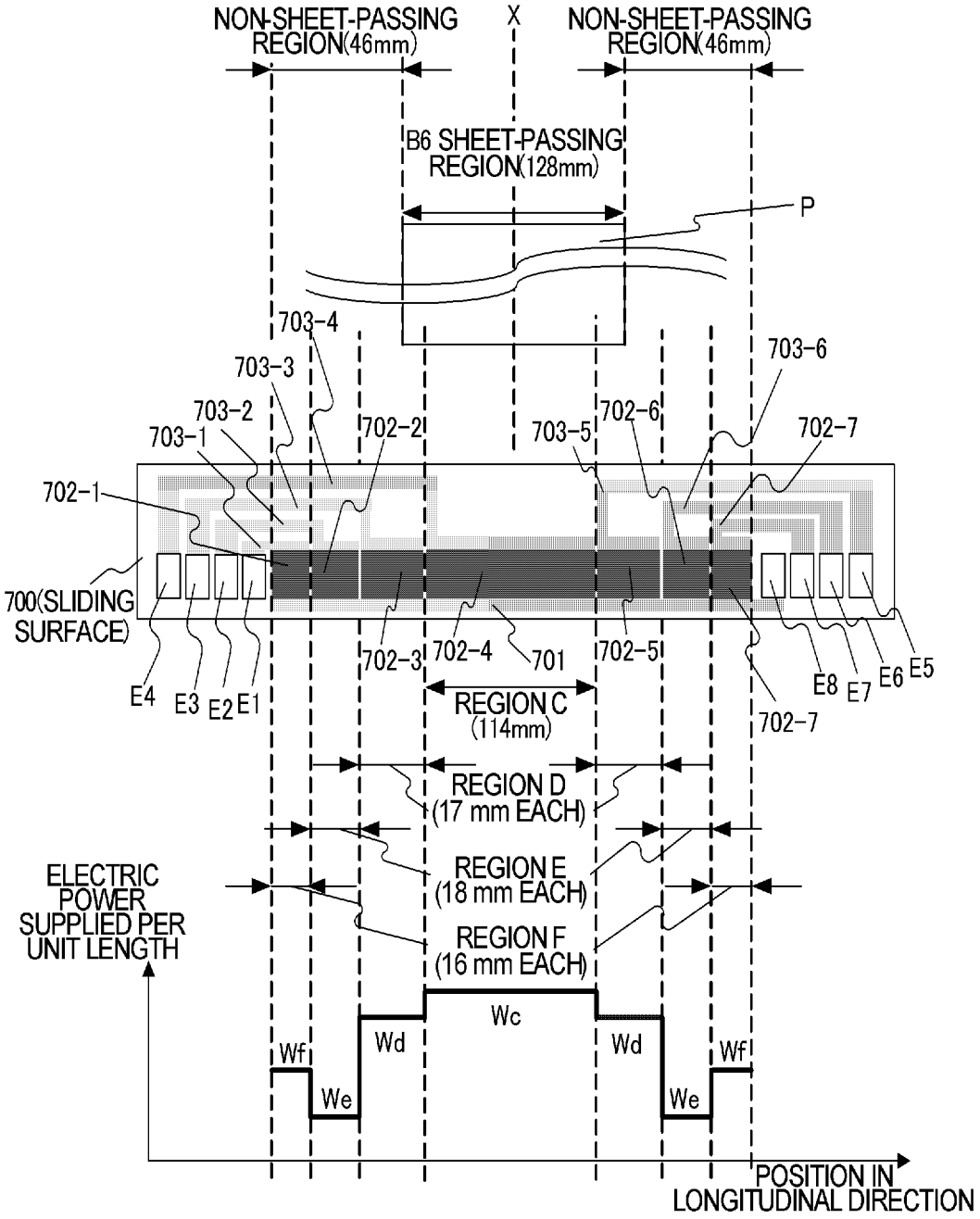
FIG. 14 is a diagram illustrating a relationship between a heat generating block according to Embodiment 3 and electrical power supplied per unit length.

FIG. 14 illustrates the relationship between a heat generating block according to the present embodiment and an electrical power supplied per unit length. The heater 700 of the present embodiment has the heat generating block 702-4 as the heat generating block C and a unit power We in the longitudinal direction is supplied to the heat generating block 702-4. Moreover, the heater 700 of the present embodiment has the heat generating blocks 702-3 and 702-5 as the heat generating block D and a unit power Wd in the longitudinal direction is supplied to the heat generating blocks 702-3 and 702-5. Furthermore, the heater 700 of the present embodiment has the heat generating blocks 702-2 and 702-6 as the heat generating block E and a unit power We in the longitudinal direction is supplied to the heat generating blocks 702-2 and 702-6. Furthermore, the heater 700 of the present embodiment has the heat generating blocks 702-1 and 702-7 as the heat generating block F and a unit power Wf in the longitudinal direction is supplied to the heat generating blocks 702-1 and 702-7.

Figure 15:
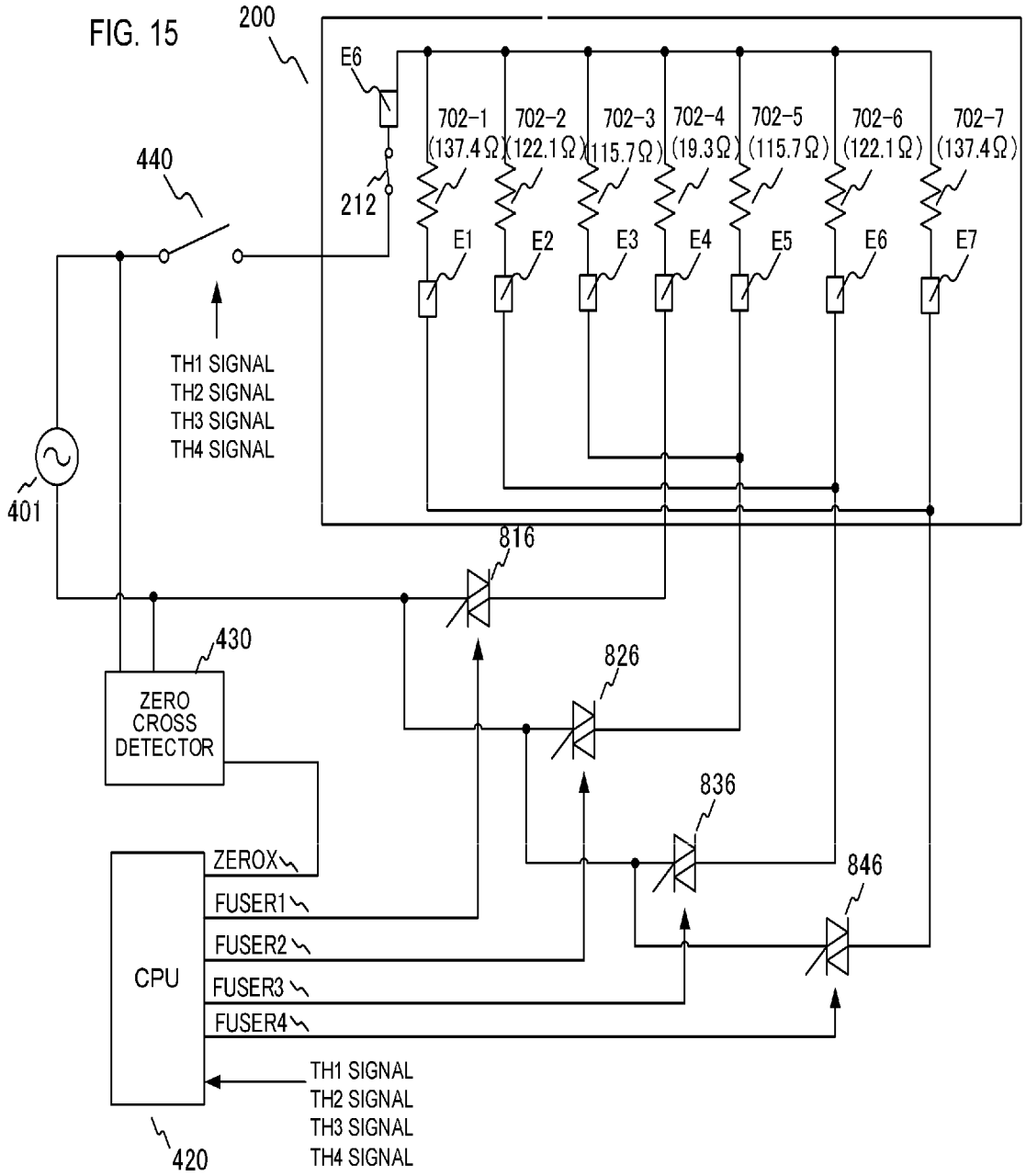
FIG. 15 is a diagram of a heater control circuit according to Embodiment 3.

FIG. 15 illustrates a diagram of a heater control circuit according to Embodiment 3. Embodiments 1 and 3 are different in that three heat generating blocks are provided in Embodiment 1, whereas seven heat generating blocks and four triacs are provided in Embodiment 3. The electrical power supplied to the heater 700 is controlled by energization/de-energization of triacs 816, 826, 836, and 846. Electrical power is supplied to the heater 700 via the electrodes E1 to E8. The resistance of the heat generating blocks 702-1 and 702-7 is set to 137.4Ω, the resistance of the heat generating blocks 702-2 and 702-6 is set to 122.1Ω, the resistance of the heat generating blocks 702-3 and 702-5 is set to 115.7Ω, and the resistance of the heat generating block 702-4 is set to 19.3Ω.

(Control Method and Verification of Advantages of Present Embodiment)

According to the control method of the present embodiment, the unit power We in the longitudinal direction of the heat generating block E that is adjacent to the heat generating block D and through which the recording material P does not pass is set to be less than the unit power Wd in the longitudinal direction of the heat generating block D through which the left and right edges of the recording material P pass so that the heat of the heat generating block D on the inner side is discharged to the outer side. Moreover, among the heat generating blocks through which the recording material P does not pass, the unit power Wf in the longitudinal direction in the heat generating block F disposed on the outer side is set to be greater than the unit power We in the longitudinal direction in the heat generating block E that is adjacent to the heat generating block D and through which the recording material P does not pass. By doing so, a decrease in the temperature at the edges of the recording material P in the longitudinal direction is prevented. Specifically, the unit power levels in the longitudinal direction supplied to the respective heat generating blocks are controlled so that a relationship of Wd>We and Wf>We is obtained.

As a first advantage of the control method of the present embodiment, it is possible to effectively decrease the peak temperature of the non-sheet-passing portion. When a B6 sheet is conveyed as the recording material P, a peak position of the temperature rise in the non-sheet-passing portion is between the left and right edges of the B6 sheet and both ends of the heat generating blocks 702-3 and 702-5. Since a temperature gradient from the peak temperature increases when the heat generation by the heat generating blocks 702-2 and 702-6 positioned on the outer side is suppressed, however, it is possible to spread and uniformize the heat at the peak position quickly.

As a second advantage of the control method of the present embodiment, it is possible to prevent a decrease in the temperature at the ends in the longitudinal direction of the heater 700. Fixing members near the heat generating blocks positioned at both ends in the longitudinal direction are more likely to radiate heat than a fixing member near a heat generating block positioned on the inner side. Therefore, by allowing the heat generating blocks 702-1 and 702-7 to generate a greater quantity of heat than the heat generating blocks 702-2 and 702-6 on the inner side, it is possible to prevent a decrease in the temperature at the ends in the longitudinal direction and to uniformize the heat quickly.

Figure 16A:
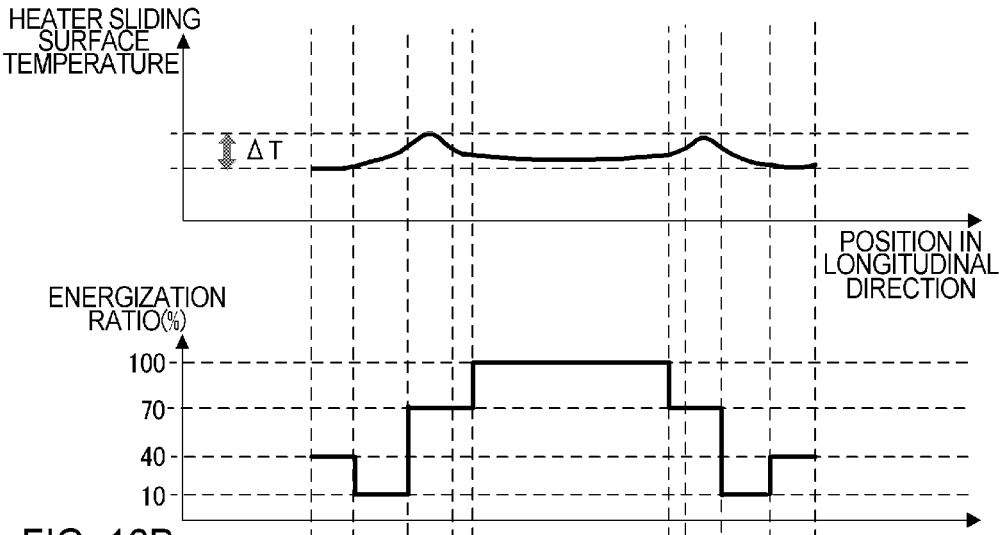
FIGS. 16A and 16B are diagrams for comparing the longitudinal temperature distributions on a heater sliding surface according to Embodiment 3 and a Comparative Example.

As an example of control method of the present embodiment, FIG. 16A illustrates a temperature distribution in the longitudinal direction of the heater 700 for the one-hundredth page when Wc:Wd:We:Wf=100:70:10:40 and continuous printing was performed on one hundred pages of B6 sheets. In the present embodiment, since the temperature is uniformized in the longitudinal direction of the heater 700 and the height difference ΔT of the temperature is small, the standby period is shorter than that of a Comparative Example, to be described later.

Figure 16B:
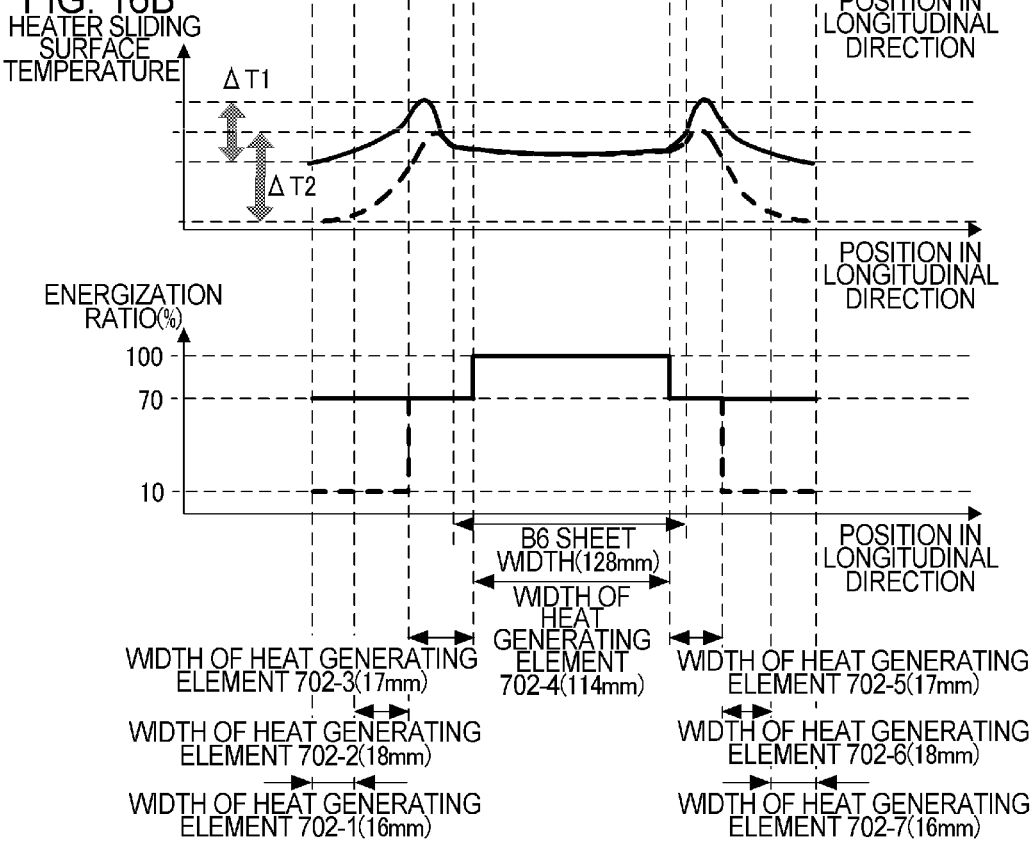

As a Comparative Example of the present embodiment, FIG. 16B illustrates the temperature distribution in the heater longitudinal direction when printing was performed under the same conditions as the present embodiment in which a solid-line graph plots the temperature distribution when Wc:Wd:We:Wf=100:70:70:70, and a broken-line graph plots the temperature distribution when Wc:Wd:We:Wf=100:70:10:10. In the solid-line graph of the Comparative Example, the height difference ΔT1 of the temperature of the heater 700 is large and the increase in the peak portion of the temperature rise in the non-sheet-passing portion is large. Moreover, in the broken-line graph of the Comparative Example, the height difference ΔT2 of the temperature of the heater 700 is large and the decrease in the temperature at the ends in the longitudinal direction is large. Due to the height difference and decrease in temperature, it is necessary to prevent high-temperature offsets or fixing faults by increasing the standby period to the subsequent printing to uniformize the temperature in the longitudinal direction of the heater 700.

(Fixing Apparatus Control Flowchart of Present Embodiment)

Figure 17:
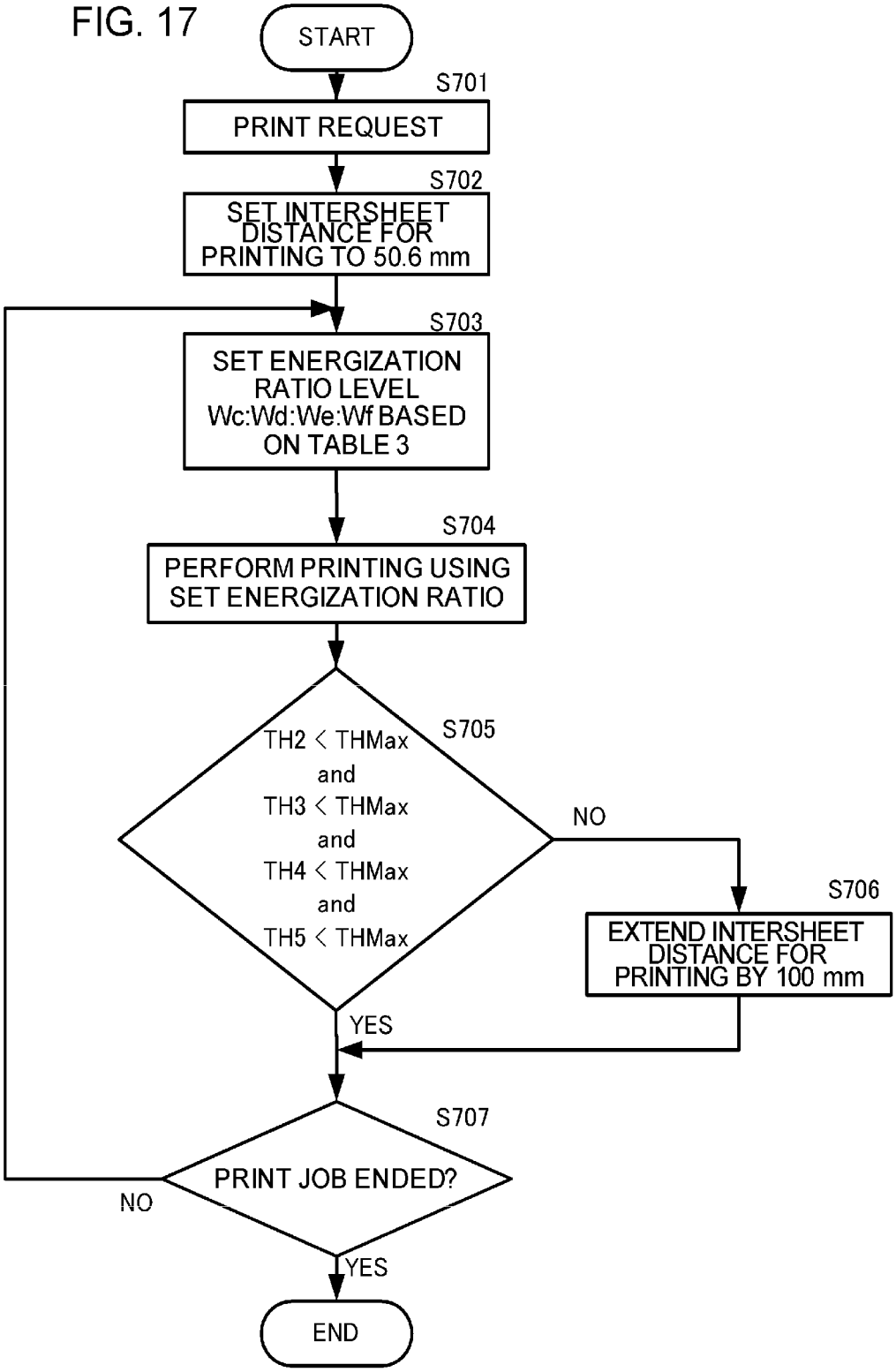
FIG. 17 is a heater control flowchart according to Embodiment 3.

FIG. 17 is a flowchart for describing a sequence for controlling the fixing apparatus 200 by the CPU 420 when the image forming apparatus 100 of the present embodiment performs printing on a recording material P having a sheet width of 114.1 mm or greater and 152 mm or less. When a print request is issued in S701, an intersheet distance for printing is set to 50.6 mm in S702. In S703, an energization ratio Wc:Wd:We:Wf is set on the basis of a sheet width of the recording material P and the number of passing sheets of a corresponding job. Specifically, the energization ratio is set on the basis of Table 3.

TABLE 3

| Sheet Width | Number of Passing Sheets: Pages 1 to 10 Wc:Wd:We:Wf | Pages 11 to 50 Wc:Wd:We:Wf | Pages 51 to 100 Wc:Wd:We:Wf | Pages 101 onward Wc:Wd:We:Wf |
|---|---|---|---|---|
| 132.1 mm~152 mm | 100:100:30:40 | 100:100:30:40 | 100:100:30:40 | 100:100:30:40 |
| 114.1 mm~132 mm | 100:100:30:40 | 100:90:20:40 | 100:80:15:40 | 100:70:10:40 |

In a recording material having a sheet width of 132.1 mm to 152 mm, described in Table 3, since the non-sheet-passing region of the heat generating block 702-3 is narrow, a temperature difference between the sheet-passing portion and the non-sheet-passing portion is small. In such a state, the energization ratio Wc:Wd:We:Wf is controlled to 100:100:30:40, regardless of the number of passing sheets, so that the temperatures of the heat generating blocks 702-1, 702-2, 702-6, and 702-7 do not decrease excessively and the rotation of the film 202 does not become unstable.

In a recording material having a sheet width of 114.1 mm to 132 mm, described in Table 3, the non-sheet-passing region of the heat generating blocks 702-3 and 702-5 is wider than that of the above-described sheet width condition, and the temperature difference between the sheet-passing portion and the non-sheet-passing portion increases. Therefore, in addition to decreasing the ratio Wd/Wc of the electrical power Wd to the electrical power We similarly to Embodiment 1, the ratio We/Wf of the electrical power We to the electrical power Wf is decreased after the number of passing sheets reaches eleven pages. In this way, the supplied electrical power is controlled so that the temperature gradient of the temperature in the region of the heat generating blocks 702-2 and 702-6 from the peak temperature position of the non-sheet-passing portion of the heat generating blocks 702-3 and 702-5 increases. In this way, the heat near the peak temperature position of the non-sheet-passing portion can be moved toward the heat generating blocks 702-2 and 702-6. In the present embodiment, the decrease in the electrical power We is increased gradually as the number of passing sheets increases within a range in which the rotation safety of the film 202 is not impaired.

In Table 3, the electrical power Wf supplied to the heat generating blocks 702-1 and 702-7 is increases as compared to the electrical power We regardless of the sheet width. This is because the quantity of heat radiated at the ends in the longitudinal direction of the heat generating blocks 702-1 and 702-7 is greater than the quantity of heat radiated in the heat generating blocks on the inner side. In the present embodiment, the quantity of heat radiated at the ends in the longitudinal direction is compensated for by setting Wf to a value that is 40% of Wc.

In S704, printing is performed using the set energization ratio and the intersheet distance set in S702 or S706.

In S705, it is determined whether the temperature detected by any one of the thermistors TH2, TH3, and TH4 exceeds the maximum temperature THMax set by the CPU 420. When the temperature of any one of the thermistors TH2, TH3, and TH4 does not exceed the maximum temperature THMax, it is determined in S707 whether a print job has ended. The flow proceeds to S703 when the print job has not ended. When the temperature of any one of the thermistors TH2, TH3, and TH4 exceeds the maximum temperature THMax, the flow proceeds to S706, the intersheet distance is extended by 100 mm, and it is determined in S707 whether a print job has ended. The flow proceeds to S703 when the print job has not ended.

These processes are performed repeatedly, and, when the end of the print job is detected in S707, the image forming control sequence ends.

As described above, in the present embodiment, it is possible to uniformize the heat generated by the heater during continuous printing by adjusting the electrical power supplied to heat generating blocks in a non-sheet-passing region according to the size of the recording material P. Therefore, it is possible to shorten the standby period for heat uniformization after continuous printing. In the present embodiment, although a configuration that includes the heat generating blocks C, D, E, and F has been described, the same advantages are obtained when the control method of the present embodiment is used for a configuration that includes the heat generating blocks D, E, and F only without including the heat generating block C.

Embodiment 4

Next, Embodiment 4, in which the heater control circuit in the fixing apparatus 200 of the laser printer 100 according to Embodiment 3 and a control method thereof are changed, will be described. Embodiment 4 is different from Embodiment 3 in that electrical power to be supplied to seven heat generating blocks can be controlled independently and the thermistor for detecting the temperature is provided in all heat generating blocks. Moreover, the energization ratios are controlled on the basis of the temperature detected by the thermistor of the heat generating block in a corresponding job. Description of constituent elements similar to those of Embodiment 3 will not be provided.

Figure 18:
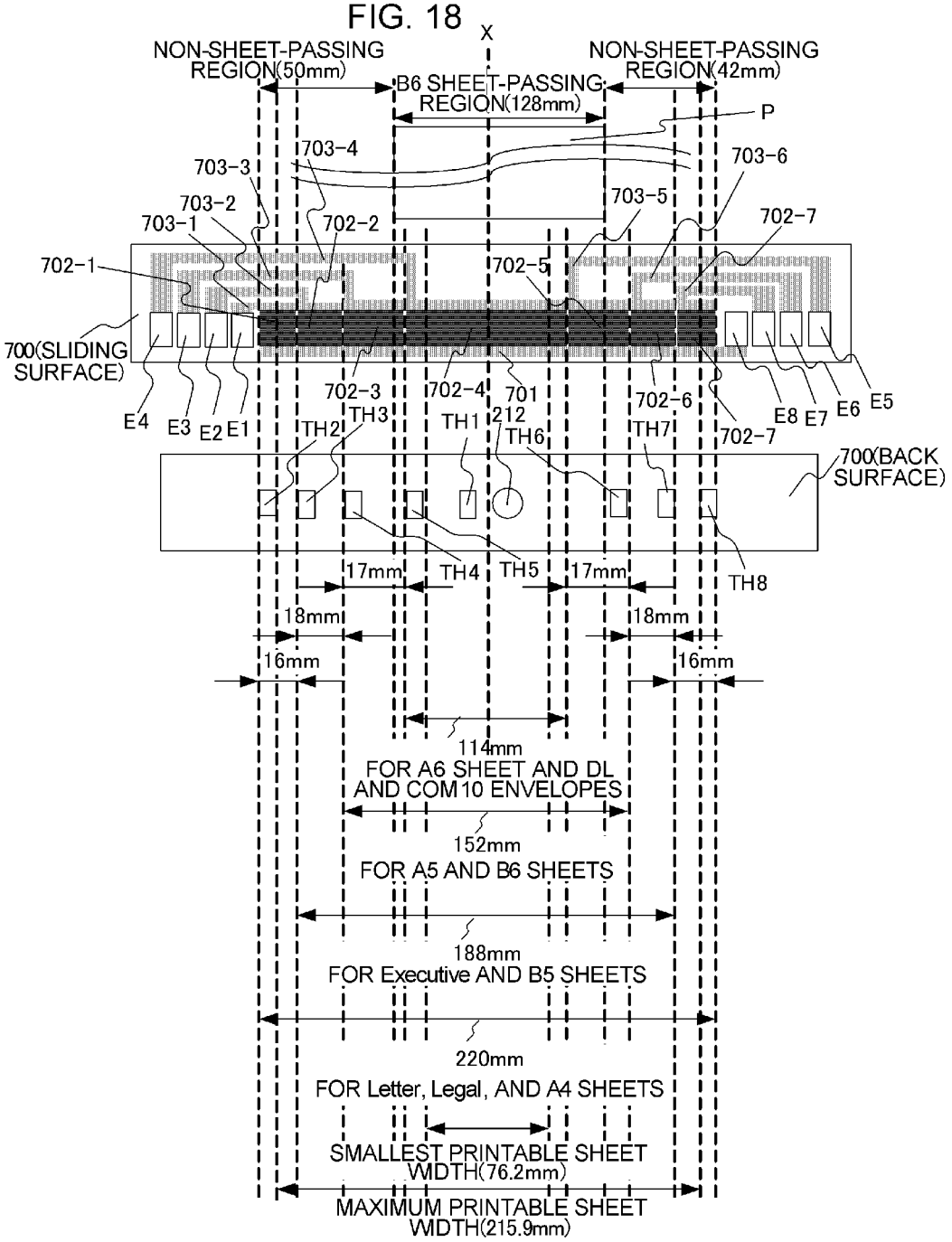
FIG. 18 is a diagram illustrating a configuration of a heater according to Embodiment 4.

FIG. 18 illustrates a configuration of a heater 700 according to Embodiment 4. Thermistors TH1 to TH8, as a temperature detection portion, and the safety element 212 are in contact with the back surface of the heater 700. The temperature of the heater 700 is controlled on the basis of the output of the thermistor TH1. The thermistor TH1 and the safety element 212 are disposed in a sheet-passing portion of a recording material P having a smallest sheet width of 76.2 mm printable by the printer of the present embodiment in the longitudinal direction of the fixing nip portion N. The temperature of the heater 700 is controlled on the basis of the output of the thermistor TH1. The thermistor TH5 detects the edge temperature of the heating region of the heat generating block 702-4 and is disposed at a position corresponding to a non-sheet-passing portion of a DL envelope (sheet width: 110 mm). Moreover, the thermistors TH4 and TH6 detect the edge temperatures of the heating regions of the heat generating blocks 702-3 and 702-5 and are disposed at positions corresponding to a non-sheet-passing portion of an A5 sheet (sheet width: 148 mm). The thermistors TH3 and TH7 detect the edge temperatures of the heating regions of the heat generating blocks 702-2 and 702-6 and are disposed at positions corresponding to a non-sheet-passing portion of an Executive sheet (sheet width: 184.15 mm). Moreover, the thermistors TH2 and TH8 detect the edge temperatures of the heating regions of the heat generating blocks 702-1 and 702-7 and are disposed at positions corresponding to a non-sheet-passing portion of a Letter sheet (sheet width: 215.9 mm).

Figure 19:
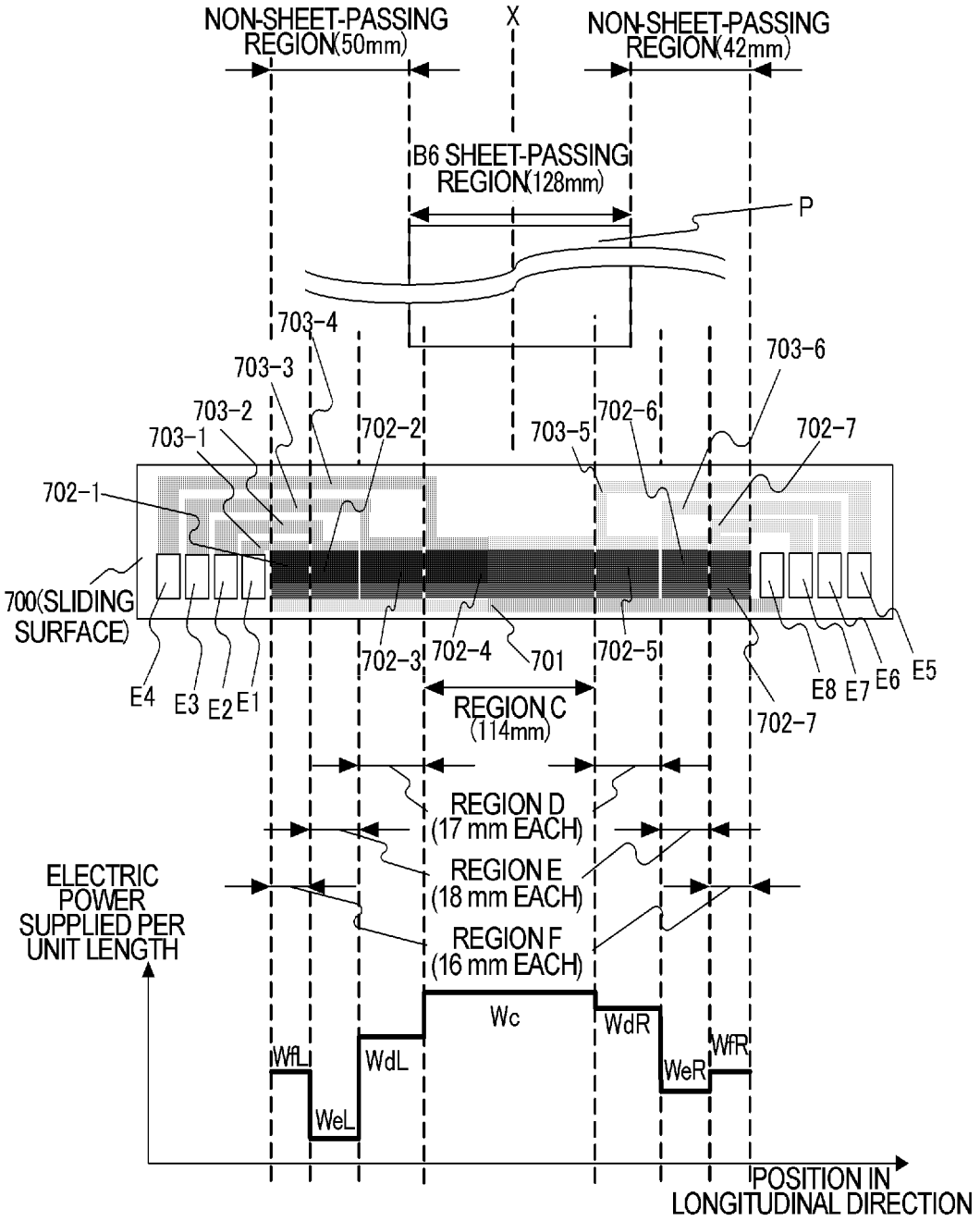
FIG. 19 is a diagram illustrating a relationship between a heat generating block according to Embodiment 4 and electrical power supplied per unit length.

FIG. 19 illustrates the relationship between a heat generating block and electrical power supplied per unit length according to the present embodiment. The heater 700 of the present embodiment has the heat generating block 702-4 as a heat generating block C and a unit power Wc in the longitudinal direction is supplied to the heat generating block 702-4. Moreover, the heater 700 of the present embodiment has the heat generating blocks 702-3 and 702-5 as a heat generating block D, a unit power WdL in the longitudinal direction is supplied to the heat generating block 702-3, and a unit power WdR in the longitudinal direction is supplied to the heat generating block 702-5. Furthermore, the heater 700 of the present embodiment has the heat generating blocks 702-2 and 702-6 as a heat generating block E, a unit power WeL in the longitudinal direction is supplied to the heat generating block 702-2, and a unit power WeR in the longitudinal direction is supplied to the heat generating block 702-6. Furthermore, the heater 700 of the present embodiment has the heat generating blocks 702-1 and 702-7 as a heat generating block F, a unit power WfL in the longitudinal direction is supplied to the heat generating block 702-1, and a unit power WfR in the longitudinal direction is supplied to the heat generating block 702-7.

Figure 20:
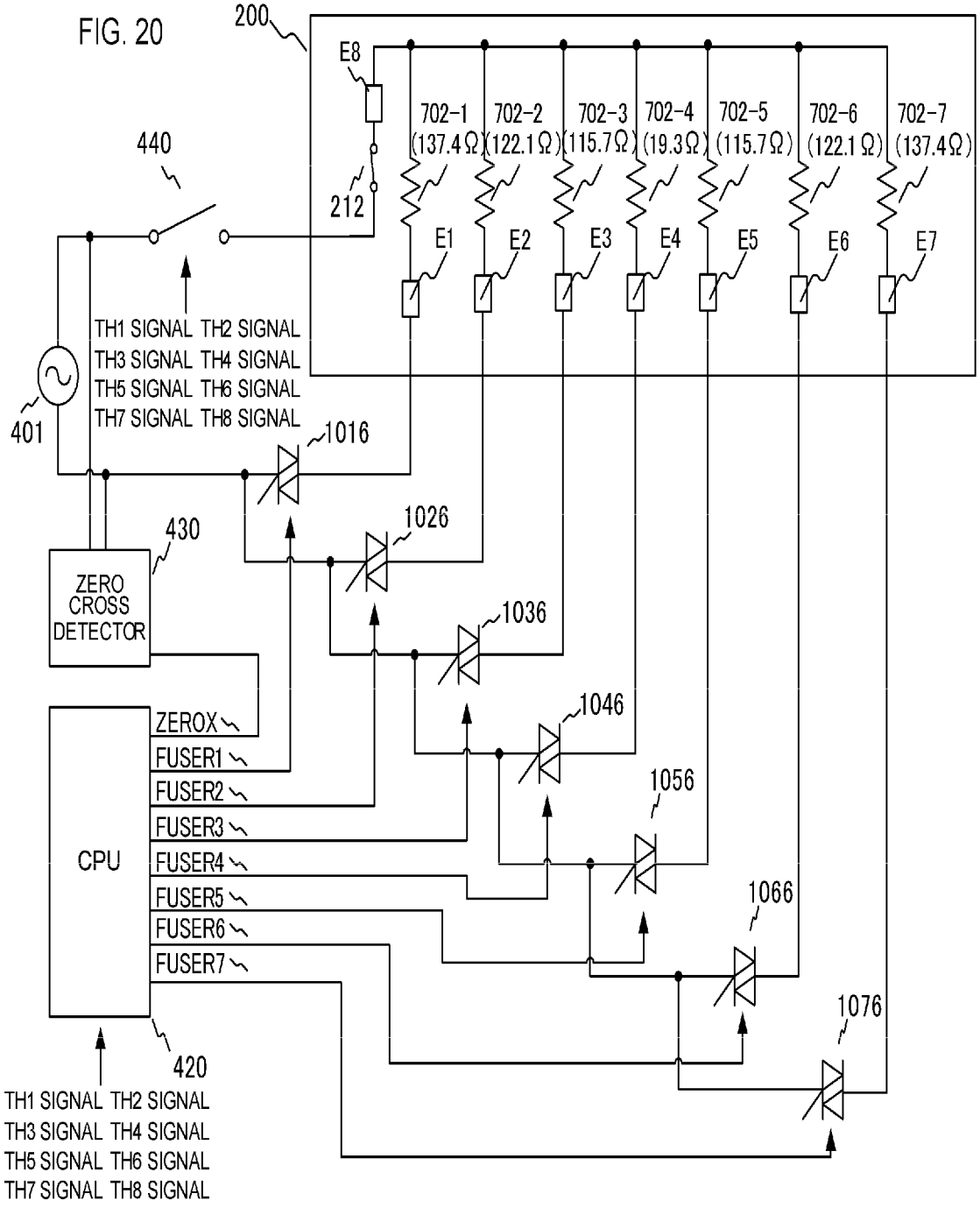
FIG. 20 is a diagram of a heater control circuit according to Embodiment 4.

FIG. 20 illustrates a diagram of a heater control circuit according to Embodiment 4. Unlike Embodiment 3, seven triacs are provided in Embodiment 4. The electrical power supplied to the heater 300 is controlled by energization/de-energization of triacs 1016, 1026, 1036, 1046, 1056, 1066, and 1076. When the triacs 1016, 1026, 1036, 1046, 1056, 1066, and 1076 are energized, electrical power is supplied to the heat generating blocks 702-1, 702-2, 702-3, 702-4, 702-5, 702-6, and 702-7, respectively. Since the circuit operation of the triacs 1016, 1026, 1036, 1046, 1056, 1066, and 1076 is similar to that of the triac 416 of Embodiment 1, the description thereof will not be provided. The driving circuits of the respective triacs are not illustrated in FIG. 20. The unit power in the longitudinal direction to be supplied to the heat generating block 702-4 will be referred to as Wc and the unit power in the longitudinal direction to be supplied to the heat generating blocks 702-3 and 702-5 will be referred to as Wd. Moreover, the unit power in the longitudinal direction to be supplied to the heat generating blocks 702-2 and 702-6 will be referred to as We and the unit power in the longitudinal direction to be supplied to the heat generating blocks 702-1 and 702-7 will be referred to as Wf. In the present embodiment, the electrical power to be supplied to the heat generating blocks 702-1 to 702-7 can be controlled independently.

(Control Method and Verification of Advantages of Present Embodiment)

In the present embodiment, the energization ratios Wc:WdL:WeL:WfL and Wc:WdR:WeR:WfR are changed gradually on the basis of a temperature difference ΔTH23 detected by the thermistors TH2 and TH3 and a temperature difference ΔTH78 detected by the thermistors TH7 and TH8, respectively. The energization ratios Wc:WdL:WeL:WfL and Wc:WdR:WeR:WfR are changed by switching the energization ratio levels XL and XR, respectively. The values of the energization ratios Wc:WdL:WeL:WfL and Wc:WdR:WeR:WfR are correlated with the respective energization ratio levels. When ΔTH23 and ΔTH78 exceed a threshold ΔTHW, the CPU 420 changes XL and XR so that the ratios WeL/WfL and WeR/WfR decrease.

Figure 21A:
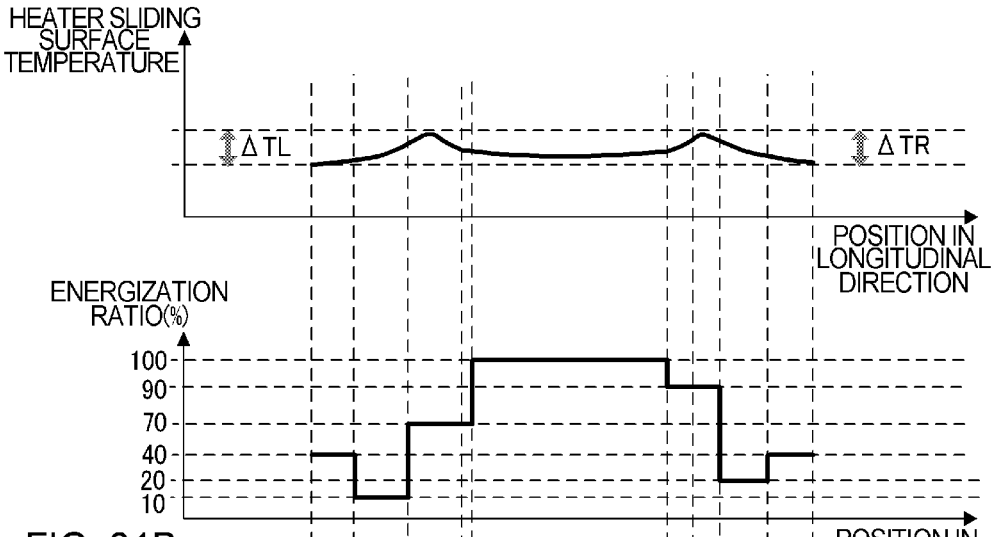
FIGS. 21A and 21B are diagrams for comparing the longitudinal temperature distributions on a heater sliding surface according to Embodiment 4 and a Comparative Example.

Next, as a verification of advantages of the present invention, a case in which printing was performed on one hundred pages of B6-size recording materials, in a state in which the central position in the longitudinal direction of a recording material is shifted toward the heat generating block 702-7 in relation to the conveying reference position X, will be described. As an example of a control method of the present embodiment, FIG. 21A illustrates a temperature distribution in the longitudinal direction of the heater 700 for the one hundredth page when Wc:WdL:WeL:WfL=100:70:10:40 and Wc:WdR:WeR:WfR=100:90:20:40. The quantity of heat generated by the heat generating block 702-2 can be decreased as compared to a Comparative Example, to be described later, by controlling the left and right energization ratio levels independently. In this way, since the heat is uniformized and the height differences ΔTL and ΔTR of temperature are small, the standby period is shorter than that of the Comparative Example to be described later.

Figure 21B:
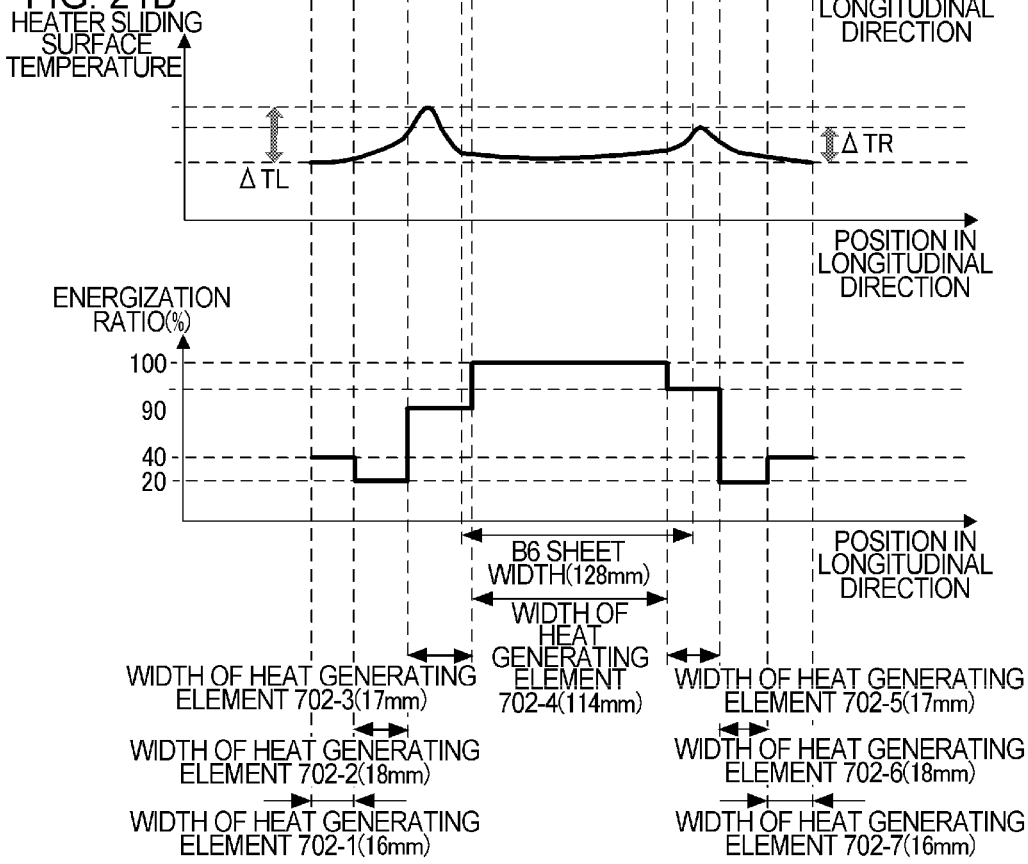

As the Comparative Example of the present embodiment, FIG. 21B illustrates the temperature in the longitudinal direction of the heater 700 when printing was performed under the same conditions as the present embodiment in a state in which Wc:WdL:WeL:WfL=Wc:WdR:WeR:WfR=100:90:20:40. In the Comparative Example, although the height difference ΔTR of temperature on the right side in the longitudinal direction of the heater 700 is small, since the height difference ΔTL of temperature on the left side is large, it is necessary to prevent high-temperature offsets or fixing faults by increasing the standby period to the subsequent printing to uniformize the heat.

(Fixing Apparatus Control Flowchart of Present Embodiment)

Figure 22:
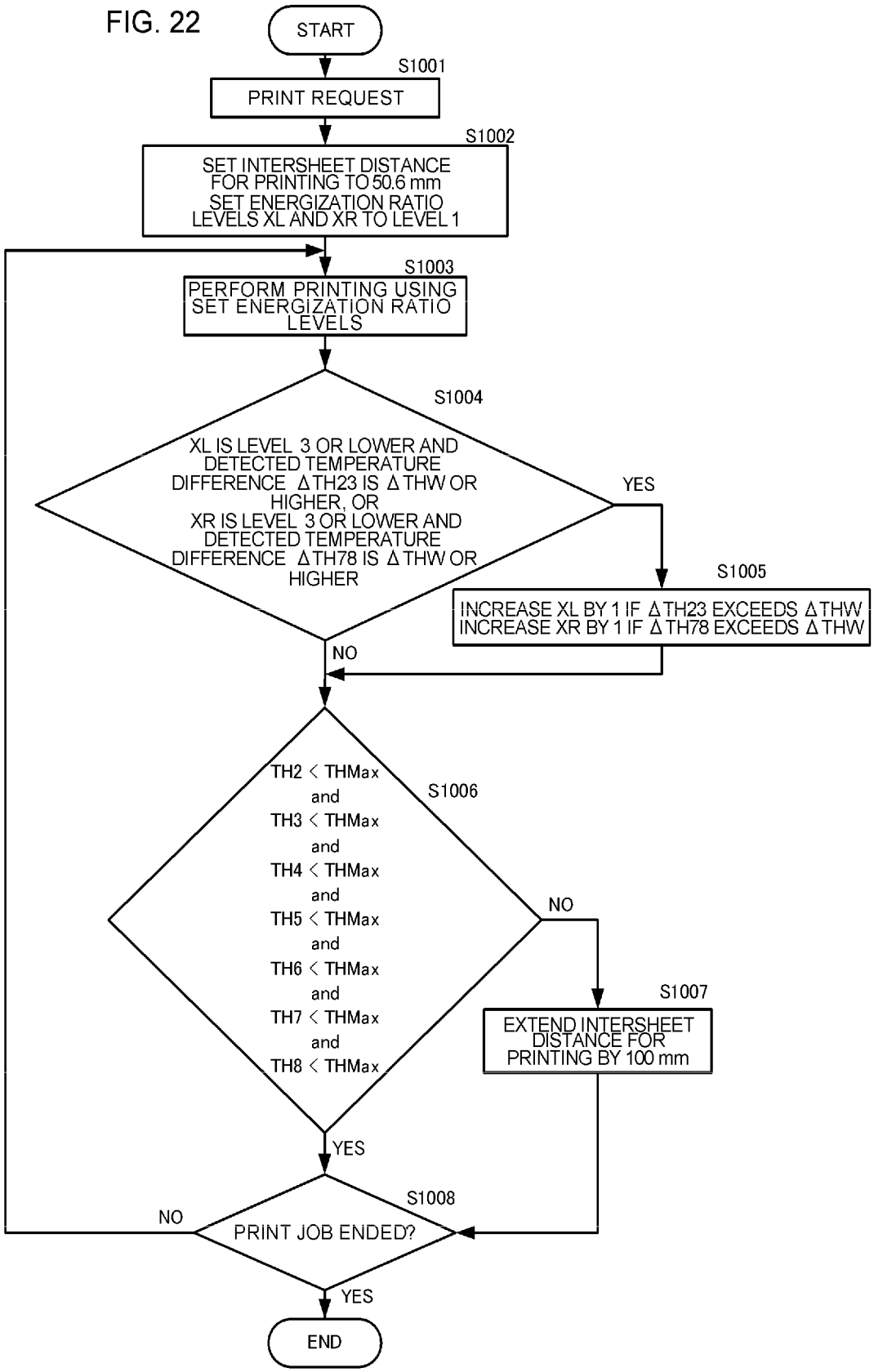
FIG. 22 is a heater control flowchart according to Embodiment 4.

FIG. 22 is a flowchart for describing a sequence for controlling the fixing apparatus 200 by the CPU 420 when the image forming apparatus 100 of the present embodiment performs printing on a recording material having a sheet width of 114.1 mm or greater and 152 mm or less. When a print request is issued in S1001, an intersheet distance for printing is set to 50.6 mm and the energization ratio levels XL and XR are set to level 1 in S1002. In S1003, the energization ratios corresponding to the set energization ratio levels XL and XR are determined on the basis of Table 4 and printing is performed using the intersheet distance set in S1002 or S1007.

TABLE 4

| | Energization Ratio Levels XL and XR | | | |
|---|---|---|---|---|
| Sheet Width | Level 1 Wc:Wd:We:Wf | Level 2 Wc:Wd:We:Wf | Level 3 Wc:Wd:We:Wf | Level 4 Wc:Wd:We:Wf |
| 132.1 mm~152 mm | 100:100:30:40 | 100:100:30:40 | 100:100:30:40 | 100:100:30:40 |
| 114.1 mm~132 mm | 100:100:30:40 | 100:90:20:40 | 100:80:15:40 | 100:70:10:40 |

In Table 4, the energization ratio level is switched whenever ΔTH23 and ΔTH78 exceed the threshold ΔTHW to decrease the quantity of heat generated by the heat generating blocks 702-2 and 702-6. The determination of the energization ratio levels for the left and right heat generating blocks 702-2 and 702-6 is performed independently. Due to this arrangement, even when the conveying position of a recording material P is shifted in the longitudinal direction and the temperatures of the non-sheet-passing portions of the heat generating blocks 702-3 and 702-5 are different, the energization ratio can be controlled in the direction of cancelling the lateral difference.

When ΔTH23 exceeds the threshold ΔTHW, the quantity of heat generated by the heat generating block 702-2 is decreased as compared to the heat generating block 702-1. When ΔTH78 exceeds the threshold ΔTHW, the quantity of heat generated by the heat generating block 702-6 is decreased as compared to the heat generating block 702-7.

For example, when continuous printing is performed on a B6 sheet (sheet width: 128 mm), continuous printing is performed in a state of the energization ratio 100:100:30:40, starting from the energization ratio level 1 for the first page of continuous printing. When the temperature difference detected in any one of the left and right thermistors exceeds the threshold ΔTHW, the energization ratio level XL or XR of a heat generating block in which the thermistor is disposed is changed to level 2. In energization ratio level 2, continuous printing is performed by changing the energization ratio Wc:WdL:WeL:WfL or Wc:WdR:WeR:WfR to 100:90:20:40. After that, when the detected temperature difference exceeds the threshold ΔTHW, the energization ratio level is changed gradually to level 3 and level 4. This is because the heat of the non-sheet-passing portions of the heat generating blocks 702-3 and 702-5 moves to the heat generating blocks 702-2 and 702-6 with the progress of the temperature rise in the non-sheet-passing portion in the heat generating blocks 702-3 and 702-5, whereby the temperature of the heat generating blocks 702-2 and 702-6 increases, and the detected temperature difference increases.

In S1004, when XL is level 3 or less and ΔTH23 is ΔTHW or greater, or when XR is level 3 or less and ΔTH78 is ΔTHW or greater, the flow proceeds to S1005. If NO is obtained in S1004, the flow proceeds to S1006.

In S1005, when ΔTH23 is ΔTHW or greater, XL is increased by 1. When ΔTH78 is ΔTHW or greater, XR is increased by one.

In S1006, it is determined whether the temperature detected by any one of the thermistors TH2, TH3, TH4, TH5, TH6, TH7, and TH8 exceeds the maximum temperature THMax set by the CPU 420. When the detected temperature does not exceed the maximum temperature, it is determined in S1008 whether the print job has ended. When the print job has not ended, the flow proceeds to S1003. When the detected temperature exceeds the maximum temperature, the flow proceeds to S1007 and the intersheet distance is extended by 100 mm. After that, it is determined in S1008 whether the print job has ended, and the flow proceeds to S1003 when the print job has not ended.

The above-described processes are repeatedly performed, and, when the end of the print job is detected in S1008, the print control sequence ends.

As described above, in the present embodiment, the energization ratios are controlled independently for the left and right sides on the basis of the temperatures detected by the thermistors TH2, TH3, TH7, and TH8. By doing so, even when the conveying reference position X of the recording material P is shifted in the longitudinal direction and the temperatures of the non-sheet-passing portions of the left and right heat generating blocks are different, it is possible to control the energization ratio in the direction for cancelling the lateral difference. Moreover, since it is possible to uniformize the heat of the heater during continuous printing, it is possible to shorten the standby period for uniformizing the heat after continuous printing.

In the present embodiment, control for switching the energization ratios of the respective heat generating blocks according to the temperature difference detected by the thermistors TH2 and TH3 or the thermistors TH7 and TH8 disposed in the heat generating blocks 702-1, 702-2, 702-6, and 702-7 of the non-sheet-passing regions has been described. The present invention is not limited, however, to this arrangement, and the electrical power We supplied to the heat generating blocks 702-2 and 702-6 may be decreased to suppress the heat generation by controlling the temperatures of the respective heat generating blocks on the basis of the temperatures detected by the thermistors TH2, TH3, TH7, and TH8. Alternatively, the same advantages are obtained by increasing the electrical power Wf supplied to the heat generating blocks 702-1 and 702-7 to accelerate the heat generation.

The energization ratios may be switched so that the heat generated by the heat generating blocks 702-2 and 702-4 is suppressed when the temperatures detected by the thermistors TH4 and TH6 disposed at the ends of the heat generating blocks 702-3 and 702-5 exceeds the threshold.

Other Embodiments

In Embodiments 1, 2, 3, and 4 described above, although the passing of the recording material P is controlled in relation to the conveying reference position X at the center, the same advantages are obtained even when the passing of the recording material P is controlled in relation to a conveying reference position located on one side. Moreover, as for the central conveying reference position X, the same advantages are obtained when the number of divisions is four or greater for Embodiments 1 and 2, and is five or greater for Embodiments 3 and 4. As for the one-side conveying reference position, the same advantages are obtained when the number of divisions is two or greater for Embodiments 1 and 2, and is three or greater for Embodiments 3 and 4.

Although heat generating elements having positive TCR are used in Embodiments 1, 2, 3, and 4, the same advantages are obtained for heat generating elements having zero or negative TCR.

According to the present invention, it is possible to minimize the throughput down for recording materials having various sheet widths and to suppress an increase in a standby period.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

We claim:

1. An image heating apparatus that heats an image formed on a recording material, the image heating apparatus comprising:

(A) a heater including:

(a) a first heat generating block; and (b) a second heat generating block disposed adjacent to the first heat generating block in a longitudinal direction of the heater, the longitudinal direction being orthogonal to a conveying direction of the recording material; and (B) a power control portion that controls electrical power to be supplied to the first and second heat generating blocks, the power control portion being capable of controlling the electrical power to be supplied to the first and second heat generating blocks independently, wherein, when (a) the recording material passes the position of the heater, and (b) an entire range, in the longitudinal direction, in which the second heat generating block is provided, is a range in which the recording material passes, and only a portion of a range, in which the first heat generating block is provided, is a range in which the recording material passes, the power control portion controls the electrical power to be supplied to the first heat generating block so that the electrical power supplied to the first heat generating block decreases as a recording material passing range, in the range in which the first heat generating block is provided, decreases.

2. The image heating apparatus according to claim 1, wherein, when (a) the recording material passes the position of the heater, and (b) the entire range, in the longitudinal direction, in which the second heat generating block is provided, is the range in which the recording material passes, and only the portion of the range, in which the first heat generating block is provided, is the range in which the recording material passes, the power control portion controls the electrical power to be supplied to the first and second heat generating blocks so that electrical power Wd supplied to the first heat generating block is less than electrical power Wc supplied to the second generating block, and wherein the power control portion controls the electrical power so that a ratio Wd/Wc of the electrical power Wd supplied to the first heat generating block to the electrical power Wc supplied to the second heat generating block decreases as the recording material passing range, in the range in which the first heat generating block is provided, decreases.

3. The image heating apparatus according to claim 2, wherein, when a plurality of recording materials is heated continuously, the power control portion changes a ratio Wd/Wc of the electrical power Wd to the electrical power Wc according to the number of the recording materials.

4. The image heating apparatus according to claim 2, further comprising (C) a temperature detection element that detects a temperature of the first heat generating block, wherein the power control portion changes a ratio Wd/Wc of the electrical power Wd to the electrical power We according to the temperature detected by the temperature detection element.

5. The image heating apparatus according to claim 2, wherein the heater further includes:

(c) a third heat generating block adjacent to the first heat generating block on a side opposite to a side on which the second heat generating block is provided; and (d) a fourth heat generating block adjacent to the third heat generating block on a side opposite to a side on which the first heat generating block is provided, and wherein, when (a) the recording material passes the position of the heater, (b) an entire range, in the longitudinal direction, in which the second heat generating block is provided, is the range in which the recording material passes, only the portion of a range, in which the first heat generating block is provided, is the range in which the recording material passes, and (c) an entire range, in which the third and fourth heat generating blocks are provided, is a range in which the recording material does not pass, the power control portion controls the electrical power so that Wd>We and Wf>We, where We is electrical power supplied to the third heat generating block and Wf is electrical power supplied to the fourth heat generating block.

6. The image heating apparatus according to claim 5, wherein the power control portion controls the electrical power so that a ratio We/Wf of the electrical power We to the electrical power Wf decreases as a range in which the recording material does not pass becomes greater than a range in which the recording material passes, in the range in which the first heat generating block is provided.

7. The image heating apparatus according to claim 5, wherein, when a plurality of recording materials is heated continuously, the power control portion changes a ratio We/Wf of the electrical power We to the electrical power Wf according to the number of recording materials.

8. The image heating apparatus according to claim 5, further comprising (C) a temperature detection element that detects a temperature of any one of the first, third, and fourth heat generating blocks, wherein the power control portion changes a ratio We/Wf of the electrical power We to the electrical power Wf according to the temperature detected by the temperature detection element.

9. The image heating apparatus according to claim 1, further comprising:

(C) a tubular film having an inner surface contacted by the heater; and (D) a pressure member that faces the heater with the film interposed therebetween, the pressure member and the film forming a nip portion, wherein the image heating apparatus heats the image formed on the recording material while conveying the recording material having the image formed thereon, in a state of pinching the recording material in the nip portion.

10. An image forming apparatus comprising:

(A) an image forming portion that forms an image on a recording material; and (B) a fixing portion that fixes the image formed on the recording material to the recording material, the fixing portion including:

(a) a heater having:

(i) a first heat generating block; and (ii) a second heat generating block disposed adjacent to the first heat generating block in a longitudinal direction of the heater, the longitudinal direction being orthogonal to a conveying direction of the recording material; and (b) a power control portion that controls electrical power to be supplied to the first and second heat generating blocks, the power control portion being capable of controlling the electrical power to be supplied to the first and second heat generating blocks independently, wherein, when (i) the recording material passes the position of the heater, and (ii) an entire range, in the longitudinal direction, in which the second heat generating block is provided, is a range in which the recording material passes, and only a portion of a range, in which the first heat generating block is provided, is a range in which the recording material passes, the power control portion controls the electrical power to be supplied to the first heat generating block so that the electrical power supplied to the first heat generating block decreases as a recording material passing range, in the range in which the first heat generating block is provided, decreases.

* * * * *